US008800673B2

(12) United States Patent
Multer et al.

(10) Patent No.: US 8,800,673 B2
(45) Date of Patent: Aug. 12, 2014

(54) FIRE PROTECTION SPRINKLERS AND SYSTEMS FOR ATTICS

(75) Inventors: Thomas L. Multer, Liberty, SC (US); George S. Polan, Liberty, SC (US); Myron L. Allen, Liberty, SC (US)

(73) Assignee: The Reliable Automatic Sprinkler Co., Inc., Liberty, SC (US)

( * ) Notice: Subject to any disclaimer, the term of this patent is extended or adjusted under 35 U.S.C. 154(b) by 959 days.

(21) Appl. No.: 12/920,061

(22) PCT Filed: Mar. 2, 2009

(86) PCT No.: PCT/US2009/035760

§ 371 (c)(1), (2), (4) Date: Oct. 18, 2010

(87) PCT Pub. No.: WO2009/108944

PCT Pub. Date: Sep. 3, 2009

(65) Prior Publication Data

US 2011/0024138 A1 Feb. 3, 2011

Related U.S. Application Data

(60) Provisional application No. 61/032,216, filed on Feb. 28, 2008.

(51) Int. Cl.
*A62C 35/00* (2006.01)

(52) U.S. Cl.
USPC ..... 169/16; 169/37; 169/54; 239/208; 239/209; 239/498; 239/504; 239/518; 239/524; 239/536; 239/565; 285/132.1

(58) Field of Classification Search
USPC ..... 169/16, 37, 54; 239/208, 209, 498, 504, 239/518, 521, 522, 524, 536, 565; 285/132.1
See application file for complete search history.

(56) References Cited

U.S. PATENT DOCUMENTS 4,585,069 A * 4/1986 Whitaker ..... 169/37
5,669,449 A 9/1997 Polan et al. ..... 169/16

(Continued)

FOREIGN PATENT DOCUMENTS

KR 20-0258499 Y1 12/2001
WO 02/30516 A1 4/2002

OTHER PUBLICATIONS

International Search Report and Written Opinion dated May 15, 2013, in International Patent Application PCT/US2009/035760.

(Continued)

*Primary Examiner* — Steven J Ganey
(74) *Attorney, Agent, or Firm* — Fitzpatrick, Cella, Harper & Scinto

(57) ABSTRACT

An attic fire protection system is provided. The system comprises a fluid supply manifold for supplying a fluid, positioned at an effective height below and parallel to the underside of a roof having a non-zero pitch angle. The system contains a plurality of fittings each having at least one exit port for directing the flow of the fluid, the fittings being spaced within at most a maximum effective distance apart from each other and being connected to receive fluid from the supply manifold, wherein the exit ports are structured to supply the fluid in a direction parallel to the underside of the roof. Most broadly, however, the fittings are structured or arranged to supply the fluid in a direction forming an oblique angle with the horizontal and the vertical, which may or may be exactly the same as the pitch angle of the roof. The system also includes a plurality of horizontal sidewall sprinklers each connected to a respective exit port of one or another of the fittings.

37 Claims, 17 Drawing Sheets

(56) References Cited

U.S. PATENT DOCUMENTS

| | | | | |
|---|---|---|---|---|
| 5,727,737 | A | 3/1998 | Bosio et al. | 239/504 |
| 5,732,511 | A | 3/1998 | Scott | 52/1 |
| 5,810,263 | A | 9/1998 | Tramm | 239/518 |
| 6,098,718 | A | 8/2000 | Sato | 169/37 |
| 6,450,264 | B1 | 9/2002 | Christian | 169/16 |
| 6,540,261 | B1 | 4/2003 | Painter et al. | 285/133.11 |
| 7,275,603 | B2 | 10/2007 | Polan | 169/37 |
| 7,426,784 | B2 | 9/2008 | Spears et al. | 29/890.14 |
| 7,487,841 | B1 | 2/2009 | Gonci | 169/16 |
| 7,614,457 | B2 | 11/2009 | Green | 169/37 |
| 7,624,813 | B2 | 12/2009 | Ma | 169/37 |
| 7,699,117 | B2 | 4/2010 | Johnston et al. | 169/43 |
| 7,784,555 | B2 | 8/2010 | Pahila | 169/37 |
| 2005/0045739 | A1 | 3/2005 | Multer | |
| 2005/0199748 | A1 | 9/2005 | Heil et al. | 239/208 |
| 2006/0070745 | A1 | 4/2006 | Polan | 169/19 |
| 2007/0034391 | A1 | 2/2007 | Pahila | |
| 2007/0215362 | A1 | 9/2007 | Rodgers | 169/46 |
| 2007/0221388 | A1 | 9/2007 | Johnson | 169/16 |
| 2008/0011491 | A1 | 1/2008 | Thau et al. | 169/37 |
| 2009/0056958 | A1 | 3/2009 | Polan | 169/40 |

OTHER PUBLICATIONS

International Preliminary Report on Patentability dated Jul. 4, 2013, in International Patent Application PCT/US2009/035760.

* cited by examiner

Section A-A

Section B-B

FIG. 23

(64) Collection Pans

Total = 13.44 gallons

Avg/Pan = 0.21 gallon

| | | | | | |
|---|---|---|---|---|---|
| | | | | | 24'-0" from peak to edge of collection pans |
| | | | | | |
| | | | | | |
| | | | | | |
| | | | | | 20'-0" from peak to edge of collection pans |
| | | | | | |
| | | | | | |
| | | | | | |
| 0.03 | 0.23 | 0.16 | 0.16 | .58 | 16'-0" from peak to edge of collection pans |
| 0.27 | 0.56 | 0.56 | 0.37 | 1.76 | |
| 0.15 | 0.56 | 0.56 | 0.21 | 1.48 | |
| 0.11 | 0.48 | 0.49 | 0.16 | 1.24 | |
| 0.10 | 0.45 | 0.43 | 0.13 | 1.11 | 12'-0" from peak to edge of collection pans |
| 0.09 | 0.56 | 0.30 | 0.10 | 1.05 | |
| 0.09 | 0.56 | 0.39 | 0.08 | 1.12 | |
| 0.09 | 0.56 | 0.30 | 0.08 | 1.03 | |
| 0.13 | 0.49 | 0.38 | 0.23 | 1.23 | 8'-0" from peak to edge of collection pans |
| 0.22 | 0.44 | 0.39 | 0.30 | 1.35 | |
| 0.05 | 0.15 | 0.10 | 0.07 | .37 | |
| 0.04 | 0.09 | 0.06 | 0.03 | .22 | |
| 0.04 | 0.06 | 0.03 | 0.02 | .18 | 4'-0" from peak to edge of collection pans |
| 0.02 | 0.05 | 0.02 | 0.01 | .10 | |
| 0.01 | 0.04 | 0.02 | T | .07 | |
| 0.01 | 0.27 | 0.30 | T | .53 | |

0-4" from peak to edge of collection pans

SPRINKLER (1900)

PEAK MANIFOLD (1201)

FIG. 24

(64) Collection Pans

Total = 2.27 gallons

Avg/Pan = 0.035 gallon

| | | | | |
|---|---|---|---|---|
| 08 | 06 | 05 | 02 | .16 |
| 09 | 05 | 08 | 04 | .26 |
| 02 | 04 | 04 | 01 | .11 |
| 01 | 04 | 03 | 01 | .09 |
| 01 | 04 | 02 | T | .06 |
| 01 | 03 | 02 | 01 | .07 |
| 01 | 03 | 02 | 01 | .07 |
| 02 | 04 | 04 | 02 | .12 |
| 14 | 08 | 12 | 04 | .36 |
| 03 | 11 | 09 | 09 | .32 |
| 01 | 03 | 02 | 01 | .07 |
| 01 | 02 | 05 | 01 | .08 |
| 01 | 04 | 02 | T | .07 |
| 01 | 03 | 01 | 01 | .06 |
| 01 | 03 | 02 | T | .05 |
| 05 | 12 | 13 | 02 | .32 |

16'-0" Room peak to edge of collection pan

12'-0" Room peak to edge of collection pan

8'-0" Room peak to edge of collection pan

4'-0" Room peak to edge of collection pan

SPRINKLER

PEAK MANIFOLD

FIRE PROTECTION SPRINKLERS AND SYSTEMS FOR ATTICS

This application is a national stage application under 35 U.S.C. §371 of International Patent Application PCT/US2009/035760, filed Mar. 2, 2009, which claims priority to U.S. provisional patent application 61/032,216, filed Feb. 28, 2008.

BACKGROUND OF THE INVENTION

1. Field of the Invention

The invention relates generally to a fire protection sprinkler system, and more particularly to fire protection sprinkler systems for attics.

2. Description of the Related Art

Pitched overhead walls in buildings hold special challenges for fire sprinkler systems, particularly where beams, trusses or joists project from or are otherwise exposed beneath the lower side of the overhead wall, which may be an interior cathedral-type ceiling, the lower deck of a pitched roof, or the attic space of the underside of a pitched roof.

NFPA 13, the National Fire Protection Association standard for the installation of sprinkler systems, applies to the installation of sprinklers beneath pitched overhead walls.

Sprinklers are mounted beneath a pitched overhead wall on supply manifolds which may run perpendicular or parallel to the peak. Based on the fire hazard (light, ordinary, or extraordinary), NFPA 13 specifies adequate spacing between the supply lines and between individual sprinklers on the lines and maximum protection area per sprinkler. Under light hazard conditions, adjoining sprinklers and supply lines may be as far as fifteen feet apart, with each sprinkler allocated a floor space of up to 225 square feet to protect. For ordinary or extraordinary hazards, the protection area per sprinkler is reduced to between about 100 and 130 square feet with appropriate reductions in the spacings between individual sprinklers and supply lines to provide such average coverage.

NFPA 13 also specifies the orientation of a sprinkler's deflector with respect to overhead walls. Where conventional automatic ceiling sprinklers are employed, the sprinklers are mounted with their deflectors oriented parallel to the overhead wall beneath which they are installed. Unless otherwise listed, a residential upright sprinkler deflector should be positioned 1 to 4 inches below the overhead wall, and a residential sidewall sprinkler deflector should be positioned 4 to 6 inches below the overhead wall.

In cases where a sprinkler is installed directly beneath the peak of a pitched roof, its deflector may be oriented horizontally. Also, per NFPA 13 (8.6.4.1.3), the deflectors of sprinklers that are located below and near the peak, rather than directly under the peak, are to be no more than 36 inches below the peak, except on a steeply pitched roof, where the distance may be increased to assure a horizontal clearance of not less than two feet from other structural members on either side of the sprinkler. Apart from these restrictions, sprinklers are permitted to be installed otherwise in accordance with their listings with respect to their spacing from one another and along branch lines and with respect to the spacing of their deflectors from the overhead wall.

Conventional fire sprinkler protection practice, as embodied in NFPA 13, is directed to controlling fires occurring beneath the sprinklers and not to controlling fires which may occur above the sprinklers.

Prior attempts to provide a residential attic sprinkler system in compliance with NFPA 13 have been made, notably in U.S. Pat. No. 5,669,449. In that patent, the inventors catalog failed attempts to comply with the NFPA 13 specification for this application using conventional sidewall sprinklers.

In particular the inventors of the '449 patent found in actual fire tests that the installation of conventional, modern ceiling sprinklers in pitched roofs in accordance with NFPA 13 can permit secondary fires to start and burn above the sprinklers, particularly in areas in the peak of the roof or a cathedral ceiling, which is not adequately protected by conventional sprinklers installed in accordance with NFPA 13 requirements. Those inventors found this to be particularly true where structural members such as beams, joists, trusses or the like project downwardly from the deck of the pitched overhead wall to form courses. With such a structure, the courses between adjacent beams direct heated air from a fire straight up the pitched portion of the ceiling or roof to the peak. The deflectors of standard ceiling sprinklers are configured to direct the water released by the sprinkler essentially downward in a fairly restricted cone. The '449 inventors concluded that it is often difficult or impossible even to locate and position such sprinklers in a way which conforms with NFPA 13 and yet so that their discharge is directed into one of the channels to cover the channel fully and cool any heated air which may be rising through the channel.

The '449 inventors attempted to overcome the prior problem by installing standard sidewall sprinklers at the peak of a pitched test roof. Sidewall sprinklers differ from ceiling sprinklers primarily in their deflectors and in the resulting spray distribution patterns. The spray distribution patterns of ceiling sprinklers are generally symmetric and conical with respect to a centerline of the sprinkler, entirely around the sprinkler. Sidewall sprinklers discharge primarily outwardly from one side or end of the sprinkler. Conventional sidewall sprinklers provide a water distribution in which the outward (longitudinal) throw of water is greater than the lateral spread of the water, resulting in an "elliptical" or "rectangular" distribution pattern.

When the inventors of the '449 patent experimented with pairs of conventional sidewall sprinklers installed in the peak of a pitched test roof, with each sprinkler directed to throw its water down a separate one of the two courses which come together at the peak, it was found impossible to locate such sidewall sprinklers in a way in which the spray from one would not cover the other, cooling the other sprinkler and preventing its activation (known as a "cold solder" condition). Furthermore, in a significant number of instances, it was the sidewall sprinkler directed down the wrong course that would activate first, and prevent the proper fire suppressing sidewall sprinkler from ever activating.

It is believed that there is a distinct and significant need for better fire protection for pitched overhead walls such as cathedral-type ceilings and the lower sides of pitched roofs capable of utilizing suitable upright sprinklers as well as suitable sidewall fire protection sprinklers.

SUMMARY OF THE INVENTION

The first aspect of the invention is an attic fire protection system. The system is comprised of a fire retardant supply manifold for supplying a fire retardant, positioned at an effective height below and parallel to the underside of a roof having a non-zero pitch angle. The system contains a plurality of fittings each having at least one exit port for directing the flow of the fire retardant, the fittings being spaced within at most a maximum effective distance apart from each other and being connected perpendicular to the supply manifold, and the exit ports are structured to supply the fire retardant in a direction parallel to the underside of the roof. The system also includes a plurality of horizontal sidewall sprinklers each connected to a respective exit port of one or another of the fittings. Also, the plurality of fittings may be comprised of a plurality of two-port angled fittings, each having an inlet port and an exit port that are co-planar with each other and that are positioned at a fixed oblique angle relative to each other, connected such that the exit ports of the two-port angled fittings are positioned parallel to the underside of the roof.

The second aspect of the invention is directed to an attic fire protection system comprised of a plurality of fire retardant supply manifolds for supplying a fire retardant, each positioned at an effective height below and parallel to one or more portions of the underside of a roof having a non-zero pitch angle. The system is also comprised of a plurality of two-port angled fittings each having an inlet port and an exit port that are co-planar with each other and that are positioned at a fixed oblique angle relative to each other, connected such that the exit ports of the two-port angled fittings are positioned parallel to the underside of the roof. The system also includes a plurality of horizontal sidewall sprinklers each connected to a respective exit port of one or another of said two-port angled fittings.

In one embodiment of the second aspect of the invention, the system further is comprised of a plurality of two-port angled fittings, having an inlet port and an exit port, co-planar with each other and positioned at a fixed oblique angle between the inlet port and the exit port, connected such that the inlet port is connected perpendicular to the supply pipe and the exit port is positioned parallel to the underside of the roof and parallel to the supply pipe.

A third aspect of the invention is directed to an attic fire protection system comprised of a plurality of fire retardant supply manifolds for supplying a fire retardant, including at least a first and a second supply manifold positioned at an effective height below the underside of a roof, the roof having a non-zero pitch angle and having a highest portion and a lowest portion, the effective height being dependent upon the pitch angle, and the second supply manifold being positioned between the first supply manifold and the lowest portion of the roof. The supply manifolds are positioned to supply the fire retardant in a direction parallel to the underside of the roof. The system also includes a plurality of upright residential fire protection sprinklers each having a deflector and each being connected to one or another of the supply manifolds and positioned such that the deflector is parallel to the underside of the roof, wherein the sprinklers are spaced within a maximum effective distance from each other.

A fourth aspect of the invention is directed to a fitting for directing the flow of a fire retardant, comprised of a body, at least one inlet port in the body for connecting to a fire retardant supply manifold, and at least one exit port in the body for connecting to a sprinkler and directing the flow of the fire retardant. The body is structured to cause the fluid to exit through the exit port in a direction that is at an oblique angle to a direction in which the fluid passes in entering the inlet port.

A fifth aspect of the invention is directed to a horizontal sidewall fire protection sprinkler. The sprinkler is comprised of a body having an output orifice, a seal cap to seal a flow of fluid from the output orifice, a thermally-responsive element positioned to releasably retain the seal cap, and a deflector. In one version, the deflector includes rectangular base portion that has a first face that is transverse to a direction of fluid flow from the output orifice, and edge or peripheral portions surrounding the base portion and inclined toward the output orifice. At least one of the peripheral portions has a cut-out that, in a preferred embodiment, is circularly arcuate in perimeter. In another version of the deflector, a first face is transverse to the direction of fluid flow from the output orifice, and includes a shelf positioned above and substantially perpendicular to the first face, and second and third faces connected to the shelf along edges of the shelf that are perpendicular to the first face. At least one of the second and third faces is connected to the shelf at an oblique angle.

A sixth aspect of the invention is directed to a fire protection sprinkler, comprising a body having an output orifice for directing fluid along an axis, a seal cap to seal a flow of fluid from the output orifice, a thermally-responsive element positioned to releasably retain the seal cap, and a deflector. The deflector has means for directing flow in at least a first direction away from the axis, and for directing flow toward the axis in a second direction that is perpendicular to the first direction and to the axis. The deflector can have a profile which, as seen from a position on the axis of fluid flow from said orifice, extends a first length in the second direction transverse to the direction of fluid flow, and extends a second length, shorter than the first length, in a third direction that is transverse to the direction of fluid flow and transverse to said second direction.

A seventh aspect of the invention is directed to an upright fire protection sprinkler. The sprinkler includes a body having an output orifice, a seal cap to seal a flow of fluid from the output orifice, a thermally-responsive element positioned to releasably retain the seal cap, and a deflector connected to the body at a rectangular base facing the output orifice. The deflector has a first pair of opposed sides extending from a longer edge of the base towards the output orifice and having a second pair of opposed sides extending from a shorter edge of the base towards the output orifice. At least one side of the second pair of opposed sides has at least one slot extending from an outer edge thereof, and the outer edge is perpendicular to the first pair of opposed sides.

BRIEF DESCRIPTION OF THE DRAWINGS

FIG. 23 is a graphical display of test data.

FIG. 24 is graphical display of additional test data.

Reference numerals that are the same but which appear in different figures represent the same elements, even if those elements are not described with respect to each figure.

DETAILED DESCRIPTION OF THE PREFERRED EMBODIMENTS

The foregoing problems are solved by the following invention described herein.

In a first aspect of the invention a fire protection sprinkler system is provided comprised of a fluid supply manifold for supplying a fluid, positioned at an effective height below and parallel to the underside of a roof having a non-zero pitch angle. The system contains a plurality of fittings each having at least one exit port for directing the flow of the fluid, the fittings being spaced within at most a maximum effective distance apart from each other and being connected perpendicular to the supply manifold, wherein the exit ports are structured to supply the fluid in a direction parallel to the underside of the roof. The system also includes a plurality of horizontal sidewall sprinklers each connected to a respective exit port of one or another of said fittings. In one embodiment the plurality of fittings comprises a plurality of two-port angled fittings, each having an inlet port and an exit port that are co-planar with each other and that are positioned at a fixed oblique angle relative to each other, connected such that the exit ports of the two-port angled fittings are positioned parallel to the underside of the roof.

Figure 1:
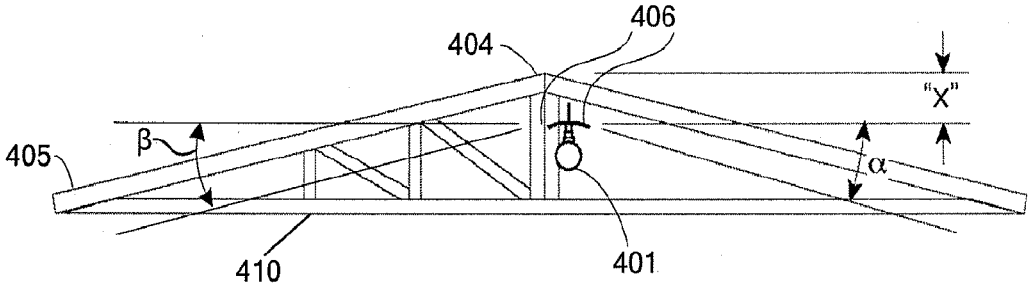
FIG. 1 is a plan view of an embodiment of the first aspect of the invention.
Figure 2:
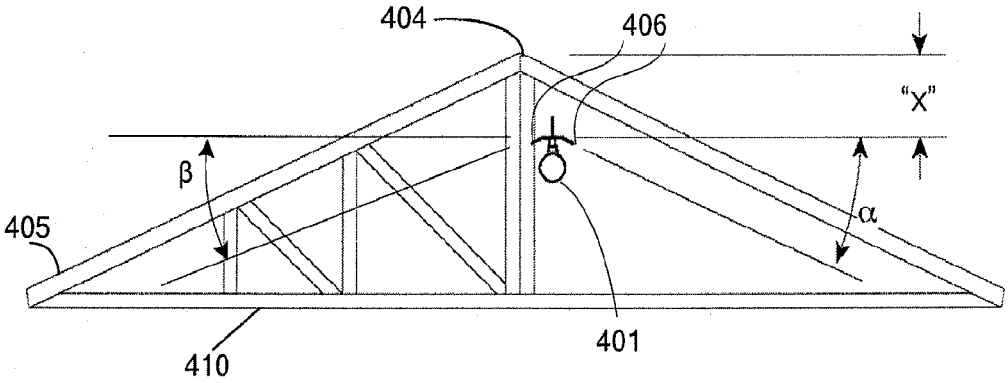
FIG. 2 is a plan view of another embodiment of the first aspect of the invention.
Figure 3:
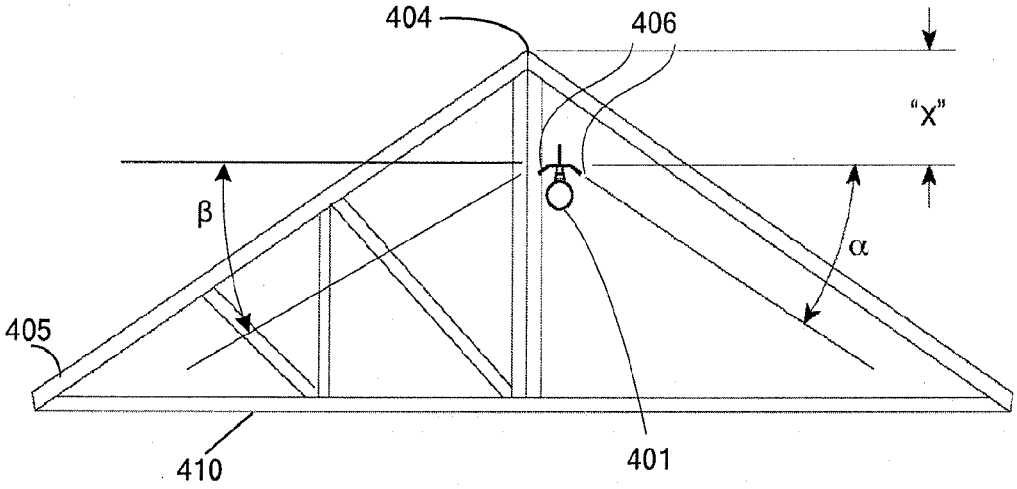
FIG. 3 is a plan view of yet another embodiment of the first aspect of the invention.
Figure 4:
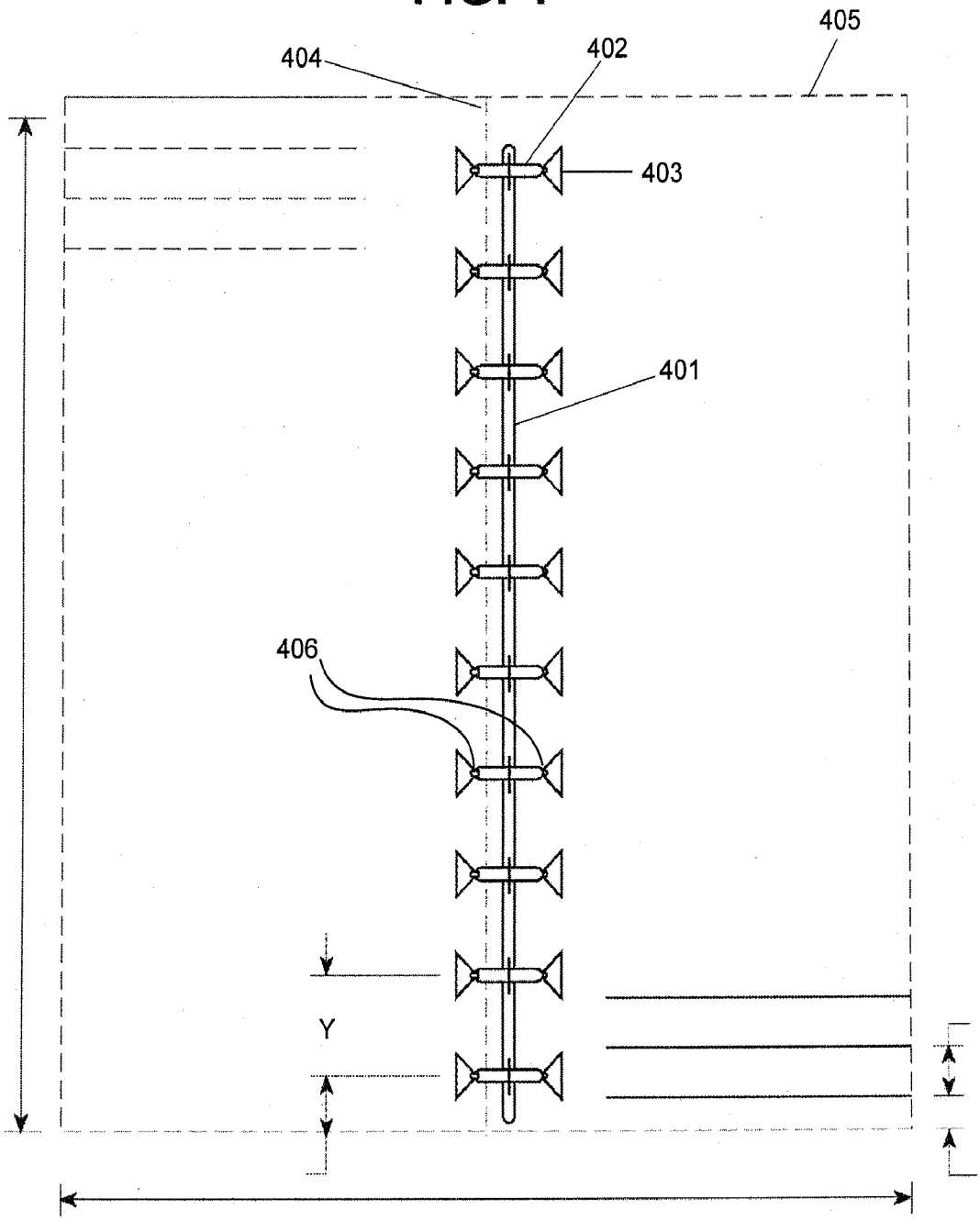
FIG. 4 is a top view of any of the embodiments of the first aspect of the invention shown in FIGS. 1-3.

FIG. 4 shows a top view of an exemplary embodiment of a fire protection system according to the first aspect of the invention. The system is comprised of a major fluid supply manifold 401 connected to a fluid supply, such as, for example, a household water supply (not shown). The fluid supply manifold 401 is positioned at an effective height "x" below the underside of the roof ridge 404 (shown in plan view in FIGS. 1-3), and positioned parallel to the underside of the roof 405. In FIGS. 1-3, manifold 401 is above the floor 410 of the space below, but the invention is also suitable for use, for example, below a cathedral-style ceiling. As mentioned above, NFPA 13 limits the height "x", in general, limited to a maximum of 36 inches (91.44 cm).

The major fluid supply manifold 401 may also be connected to at least one other minor supply manifold (not shown). Such minor supply manifolds may be arranged as branch lines and may be connected perpendicularly to the main supply manifold, although one of skill in the art will appreciate that other configurations are possible that are not so arranged. Furthermore, branch lines may further extend or turn in any required direction, and such branch lines may themselves have their own branch lines extending therefrom.

Figure 15:
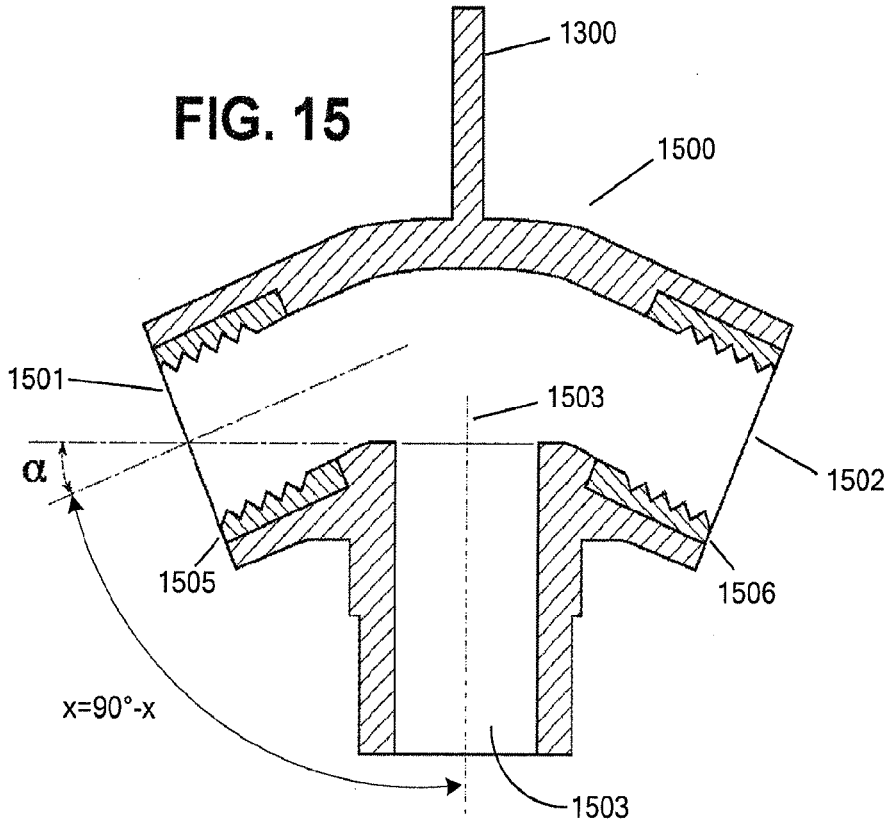
FIG. 15 is a cross-sectional view of an embodiment of a fourth aspect of the invention.
Figure 16:
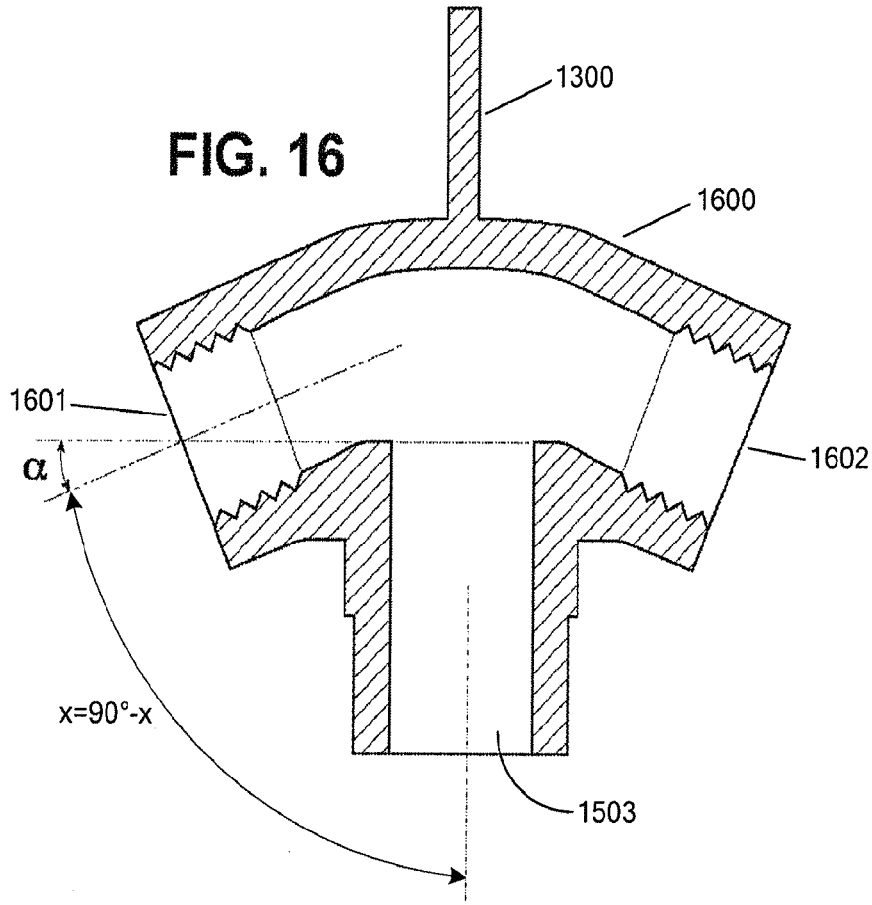
FIG. 16 is a cross-sectional view of the embodiment shown in FIG. 15.

A plurality of fittings 402, such as, for example, the multi-port fittings 1500 and 1600 shown in FIGS. 15 and 16, respectively, are connected to the top of the supply manifolds 401 and spaced apart from each other at least a minimum effective distance "y" apart. Each of these fittings 402, located substantially under the ridge 404 of the roof 405, has a plurality of exit ports 406 for directing the flow of the fluid. The inlet port of each of these fittings (not shown) is connected perpendicular to the supply manifold 402, and the plurality of exit ports 406 are positioned parallel to the underside of the roof 405, as is shown in FIGS. 1-3.

In addition to the plurality of fittings shown in FIGS. 1-4, the systems embodied therein also can include a plurality of two-port angled fittings (not shown), having an inlet port and an exit port, both ports being co-planar with each other and being positioned at a plurality of fixed oblique angles to each other, such as, for example, 60, 45, and 30 degrees (the invention, of course, encompasses any angle, and so can be used with a roof of any pitch). Such fittings can be advantageously used, for example, in applications where the side profile of the space under the roof is a right triangle and only slopes downward from the ridge in one direction. In addition, such fittings can also be used, for example, on a branch line connected to the main supply manifold.

In one embodiment of the system the supply manifold is angled at least one point along its length, such that the point is adjacent a location where two portions of the underside of the roof meet at an angle. The supply manifold, in such instance, is angled at substantially the same angle as the angle in which the two portions of the underside of the roof meet, and is spaced by the effective height from each of the two portions of the underside of the roof. An example of an application of this system would be in the underside of a hip roof.

For example, the two-port angle fittings of FIGS. 15 and 16 can also be connected to a minor supply manifold that is connected to a major supply manifold at an angle relative to the horizontal major supply manifold. Such minor supply manifolds may be connected perpendicular to the main supply manifold or as a parallel extension of the main supply manifold under a hip roof. Such minor supply manifolds may be used in special applications, such as, for example, where additional coverage is desired or in areas that are too distant to be covered by sprinklers attached to the main supply manifold.

In the embodiment of the systems shown in FIGS. 1-4, connected to each exit port 406 of the fittings 402 is a horizontal sidewall sprinkler 403 that is capable of delivering the fluid in substantially one direction. In another embodiment, one or more of the exit ports can be closed with a sealing plug.

In the embodiment of the fire protection system shown in FIG. 1, a side view of the attic space under the roof 405 is shown. The angles between the roof and the horizontal are shown as pitch angles α and β. Angles α and β may or may not be equal.

In FIGS. 1-3 the main supply manifold 401 runs horizontally, both parallel to and below the ridge 404 of the roof 405 at an effective height "x" below the ridge. The exit ports 406 of the plurality of fittings 402 attached to the main supply manifold 401 are positioned to be substantially parallel to the underside of the roof 405. To accomplish this, fittings such as the multi-port fittings 1500 and 1600 of FIGS. 15 and 16 can be configured and connected to the main manifold.

In the embodiment shown in FIG. 15, the fitting 1500 contains a body having two exit ports 1501, 1502, and one inlet port 1503. The exit ports 1501, 1502 contain connection inserts 1505, 1506, that may be attached to the fitting body 1500 by, for example, an adhesive or other suitable connection method. In the example embodiment shown in FIG. 15 the inserts 1505 and 1506 contain a threaded connection portion. The inserts 1505 and 1506 allow other fluid transfer elements, such as the sprinklers, to be connected to the output ports 1501, 1502.

The body 1500 and the inserts 1505, 1506 may be made out of various suitable materials, including, for example, PVC or brass. Use of different materials is advantageous in cases where the fluid transfer devices, such as the body of a sprinkler or sealing plugs, need to be of the same material as the piece they are connected to, in order to ensure proper sealing properties, for example. It will also be appreciated by one of skill in the art that the materials used for the inserts 1505, 1506 may be different for different outlet ports 1501, 1502 of the fitting.

In addition to the inserts 1505, 1506 being made of different materials, the inserts can also have different types of fasteners as well. For example, depending on the ultimate application and the availability of fluid transfer fittings (e.g., sprinklers and sealing plugs) with standardized fasteners may be limited, and therefore a fitting with modular inserts will offer design flexibility to an installer of the fire protection sprinkler system simply to use a fitting configured with an insert having a compatible fastening means as the fluid transfer element. This modular approach is also advantageous for manufacturing of the fittings, because a manufacturer may standardize on manufacturing the larger body and offer customized fittings with inserts upon receipt of a customer order or configure the body to be customized at the point of use by the installer (end user). Also, while the fittings are shown as being unitary (apart from the inserts 1505, 1506), it is also within the invention to use a non-unitary construction for the fittings, if desired. Moreover, it will also be appreciated that other fluid transfer elements need not direct fluid out of the fittings 1500 and 1600 within the plane of the respective exit ports 1501,1502 and 1601, 1602.

FIG. 16 shows a similar fitting to that of FIG. 15, where exit ports 1601 and 1602 contain integral fasteners (e.g., threads) that are molded or machined into the fitting body 1600.

The exit ports 1501 and 1502 are configured such that they are positioned at angles β and α, respectively, relative to the horizontal. The angles β and α are configured to be the same as the respective pitch angles β and α of the roof shown in FIGS. 1-3. It should be appreciated by one of skill in the art that while the fitting 1500 is shown with two exit ports 1501 and 1502, in other embodiments the fitting may have more than two exit ports and those exit ports may be positioned at angles relative to the inlet port that are different from one another so as to position the outlet ports parallel to the surface above them (i.e., the underside of a roof).

In FIG. 2 the roof pitch angles α and β are larger than the corresponding roof pitch angles α and β shown in FIG. 1. Consequently, where α and β are equal, the corresponding fitting angles α and β in FIGS. 15 and 16, are larger in fittings used in the system of FIG. 2 than the corresponding fitting angles α and β used in the system shown in FIG. 1.

Similarly, in FIG. 3, because the roof pitch angles α and β are larger than the corresponding roof pitch angles α and β in the systems shown in FIGS. 1 and 2, the plurality of fittings connected to the main supply manifold 401 are configured with fitting angles α and β (FIGS. 15 and 16) that are again larger than the corresponding fitting angles of the fittings used in the systems shown in FIGS. 1 and 2.

Figure 13:
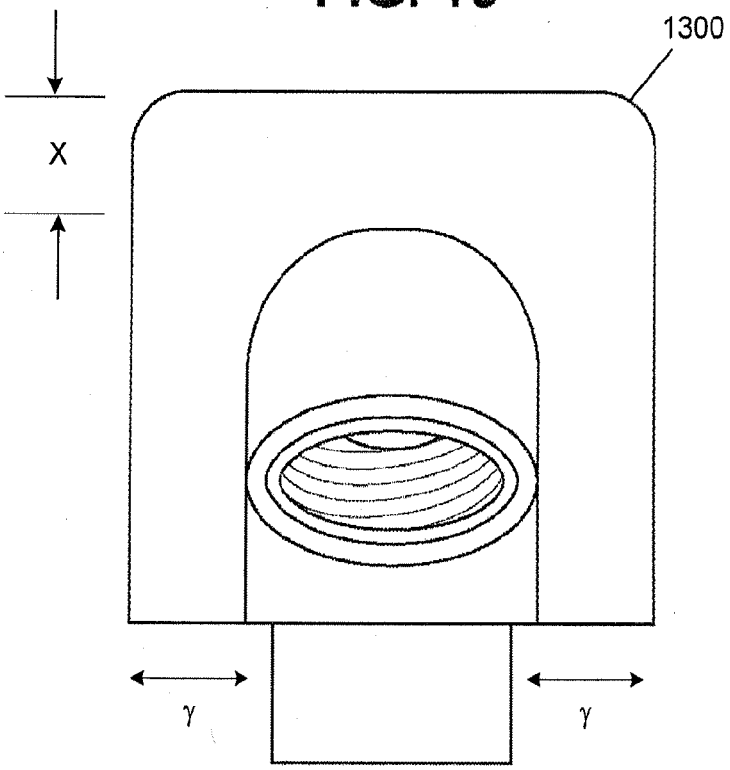
FIG. 13 is a side view of one embodiment of a splash guard.
Figure 14:
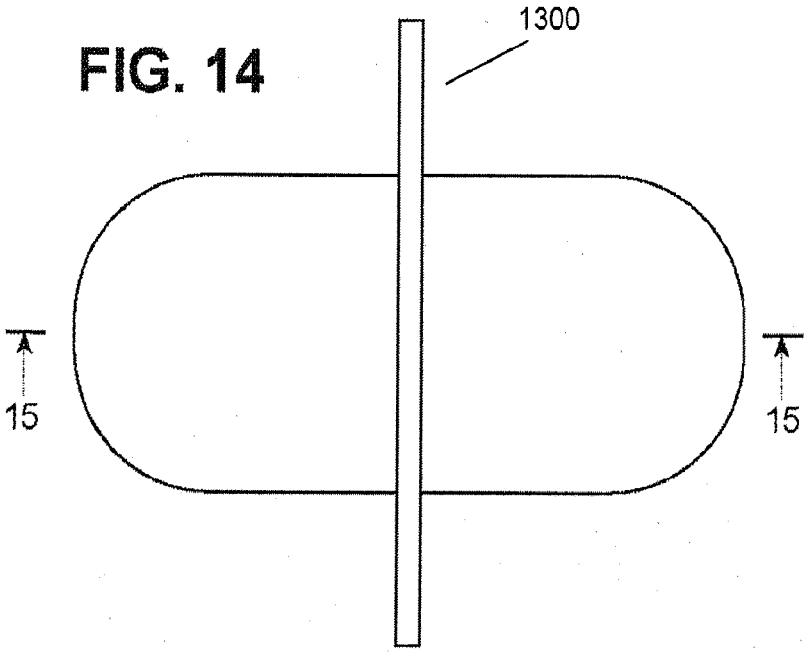
FIG. 14 is a top view of the splash guard shown in FIG. 13.

The fittings shown in FIGS. 15 and 16 may also be configured to include a splash guard 1300, respectively, such as those shown in those figures and in FIGS. 13 and 14. The splash guards 1300 may be integral with the bodies 1500 and 1600 or may be made separately and attached, as in FIGS. 13 and 14.

The splash guard 1300, among other things, aids in preventing "cold soldering" of fire protection sprinklers in the event of a fire. A cold solder condition, as mentioned previously, occurs when an early-acting sprinkler is activated by sensing a temperature rise in the vicinity of the sprinkler's thermally responsive element. If a temperature rise is initially localized, a sprinkler immediately nearby may actuate before another sprinkler located further away. However, if the early-acting sprinkler directs stray fluid in the direction of nearby sprinklers that have not actuated, the thermally responsive elements of these latter sprinklers may sense a local temperature near the element that is lower than what actual existing bulk conditions are in the vicinity below the sprinkler. As a result, the sprinklers experiencing this cold solder condition will react more slowly (as if they were soldered closed) than designed, due to the effect of fluid from the earlier-acting sprinkler(s).

To solve this cold solder condition in residential sprinkler applications, a splash guard is provided. FIG. 13 shows a view of one embodiment of a splash guard 1300. As a separate unit the splash guard 1300 can be fastened over an exterior surface of a fitting body 1500, 1600. The splash guard 1300 can be fastened by a snap fit connection, or other suitable fastening means.

FIG. 13 shows a view of the splash guard 1300 as would be seen when installed on a fitting such as that of FIG. 15 and viewed looking at one outlet port 1501. The splash guard 1300 extends a distance Y on either side of the housing and extends above the top of the housing a distance X. The distances X and Y are sufficient to prevent a cold solder condition due to the effect of nearby active sprinklers, including any other sprinklers connected to the same fitting.

It will be appreciated that splash guards having other configurations are possible to cover the outlet ports of fittings having a plurality of outlet ports, and that the shapes used are not limited to the example embodiments shown in FIGS. 13 and 14.

It will be appreciated that any fittings configured with a plurality of exit ports could be used with fewer exit ports by introducing a sealing plug into one or more of the exit ports to block exit flow of fluid. For example, the "tee" shaped fittings of FIGS. 15 and 16 can be used as an elbow fitting having a single open exit port and a single closed exit port closed by a sealing plug. Such a configuration can be used, for example, in the fire protection sprinklers shown in FIGS. 1-4 and 5-8.

A second aspect of the invention, embodied in FIGS. 5-8, is a fire protection system comprised of a plurality of fluid supply manifolds for supplying a fluid, each positioned at an effective height below and parallel to one or more portions of the underside of a roof having a non-zero pitch angle. The system also includes a plurality of two-port angled fittings each having an inlet port and an exit port that are co-planar with each other and that are positioned at a fixed oblique angle relative to each other, connected such that the exit ports of the two-port angled fittings are positioned parallel to the underside of the roof. The system also includes a plurality of horizontal sidewall sprinklers each connected to a respective exit port of one or another of the two-port angled fittings.

Figure 7:
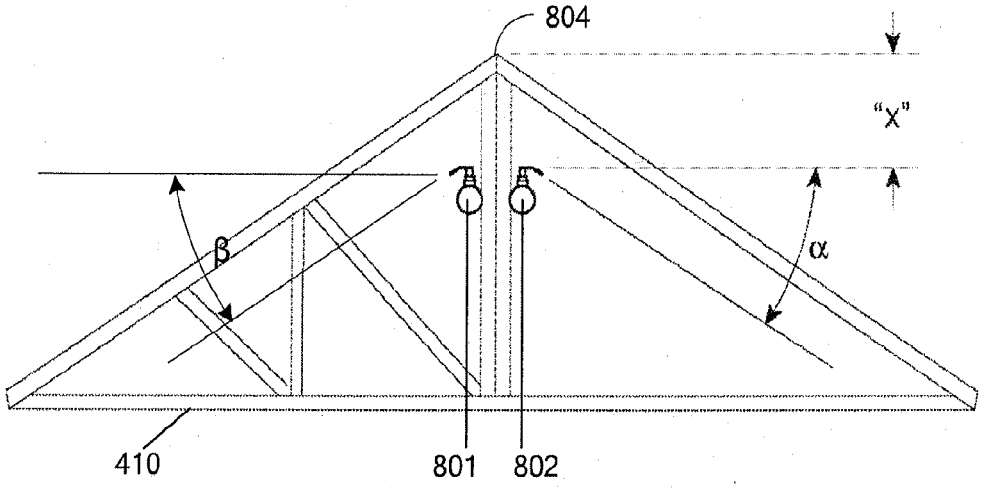
FIG. 7 is a plan view of yet another embodiment of the second aspect of the invention.
Figure 8:
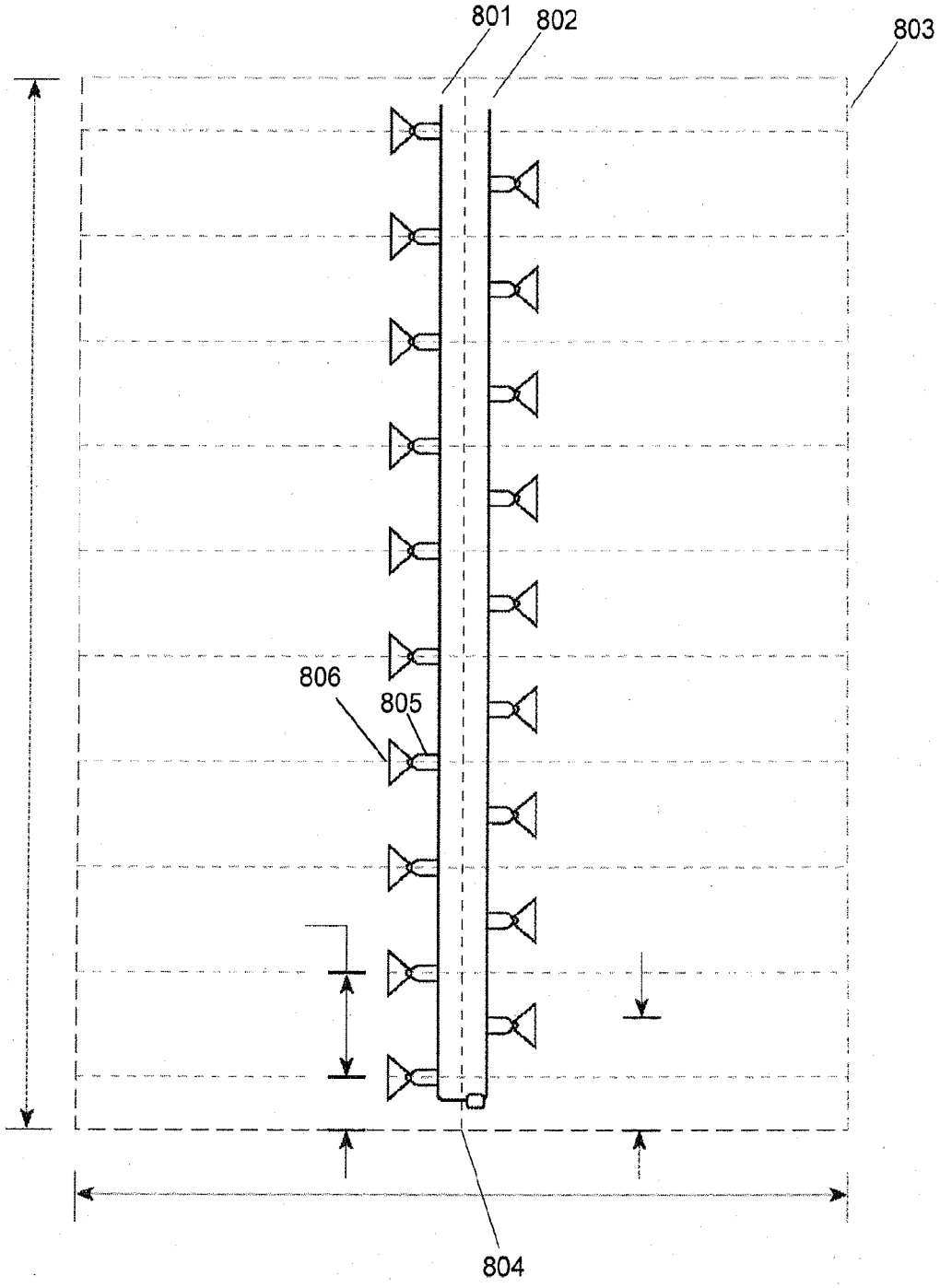
FIG. 8 is a top view of any of the embodiments of the second aspect of the invention shown in FIGS. 5-8.

FIG. 8 shows a top view of one embodiment of the fire protection system in accordance with the second aspect of the invention. The system in FIG. 8 is comprised of two main fluid supply manifolds 801 and 802. As shown in the side views of FIGS. 5-7, these fluid supply manifolds are positioned parallel to each other at an effective height "x" below the underside of the roof ridge 804, running horizontally and parallel to the underside of the roof ridge 804 (as is shown in FIGS. 5-7).

In another embodiment of the second aspect of the invention, the major fluid supply manifolds 801 and 802 may also be connected to at least one other minor supply manifold (not shown). Such minor supply manifolds may also be arranged as branch lines, as described above with respect to the embodiments described earlier. Branch lines may connect to the main supply manifold, for example, perpendicularly to the main supply manifold running parallel to the underside of the roof.

In the embodiment of the fire protection sprinkler system shown in FIG. 8, the two supply manifolds 801 and 802 are connected together in a "U" shape substantially below the roof ridge 804. Attached to the supply manifolds are dual-port angled fittings 805, each having a single inlet port and a single outlet port, and each connected to a respective horizontal sidewall sprinkler 806. The dual-port angled fittings 805 are connected to the supply manifolds 801, 802 and are spaced apart from each other no closer than a minimum effective distance. In addition, the dual-port fittings 805 on the parallel main supply manifolds are connected to the manifold at an offset distance from the sprinklers 806 on the opposing manifold. The offset distance between sprinklers on opposing main supply manifolds 801, 802 is preferably about one half of the minimum effective distance. In the system of FIG. 8 the plurality of main supply manifolds are connected together; however, it will be appreciated that in another configuration both supply manifolds may be separate manifolds each supplied with fluid from one or more separate supplies. In yet another embodiment of the invention (not shown), the opposing sprinklers on each manifold are aligned with each (not offset along the manifolds 801, 802).

Figure 5:
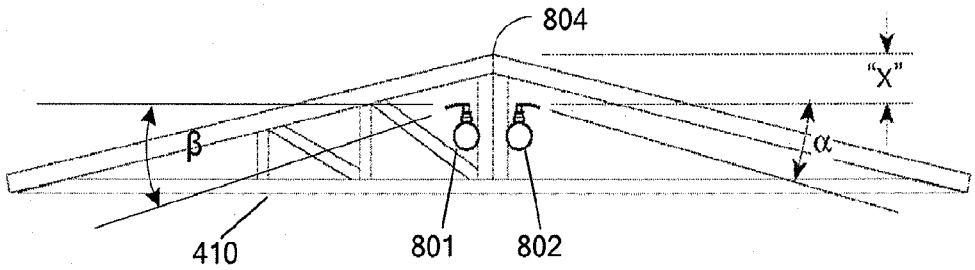
FIG. 5 is a plan view of an embodiment of the second aspect of the invention.
Figure 6:
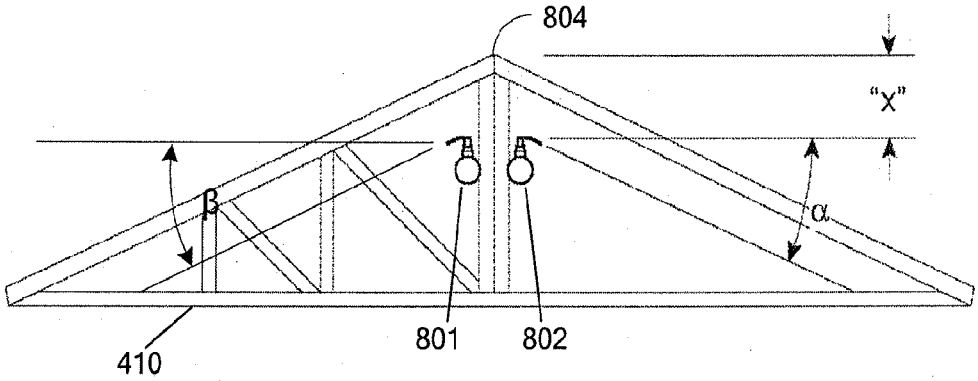
FIG. 6 is a plan view of another embodiment of the second aspect of the invention.

FIGS. 5-7 show side views of the system of FIG. 8 implemented in attics having different roof pitches. FIGS. 5-7 show two main supply manifolds 801, 802 substantially below the underside of the roof ridge 804 at an effective height "x". In FIGS. 5-7 the right side of the roof is pitched at an angle $\alpha$ relative to the horizontal, and the left side of the roof is pitched at an angle $\beta$ relative to the horizontal. Two-port angled fittings are shown connected perpendicular to the tops of the main supply manifolds 801, 802. The angled fittings 805 on the left supply manifold 801 have exit ports positioned at an angle $\beta$, relative to the horizontal, such that the outlet port is directed substantially parallel to the underside of the roof 803. Likewise, the angled fittings 805 on the right supply manifold 802 have exit ports positioned at an angle $\alpha$, relative to the horizontal, such that the outlet port is directed substantially parallel to te underside of the roof 803.

In other embodiments of the system shown in FIGS. 5-8, such as when branch lines are installed, the system can include a plurality of two-port angled fittings, having an inlet port and an exit port co-planar with each other (that is, the axes of flow at the two ports are co-planar) and positioned at a fixed angle between the inlet port and the exit port, connected such that the inlet port is perpendicular to the supply pipe and the exit port is positioned parallel to the underside of the roof.

The fittings connected to the left and right main supply manifolds 801, 802 are configured to have exit ports positioned at angles relative to the horizontal such that they are parallel to the underside of the portion of the roof 803 they are positioned under as well as perpendicular to the main supply manifold.

As will be appreciated by one of skill in the art, using dual-port angled fittings in cases where the pitch angles $\alpha$ and $\beta$ are not equal is advantageous for manufacturers and installers by avoiding the need to manufacture a fitting with a unique combination of outlet ports, and allows manufacturers and installers greater flexibility to manufacture and install less specialized components that provide substantially equivalent functionality of a more specialized fitting when more standardized components are used in a modular manner.

FIGS. 6 and 7 show other example embodiments of the fire protection sprinkler system of FIG. 8 with attics having progressively larger roof pitch angles. In FIG. 6 the roof pitch angles $\alpha$ and $\beta$ (corresponding to those angles in FIG. 5) are larger than those in FIG. 6, and in FIG. 7 the roof pitch angles $\alpha$ and $\beta$ are still larger. In the embodiment of the system shown in FIGS. 6 and 7 the outlet ports of the fittings connected to the manifolds 801, 802 are configured to be substantially parallel to the roof 803 and are configured to direct water substantially perpendicular to the main supply manifolds 801, 802.

Figure 18:
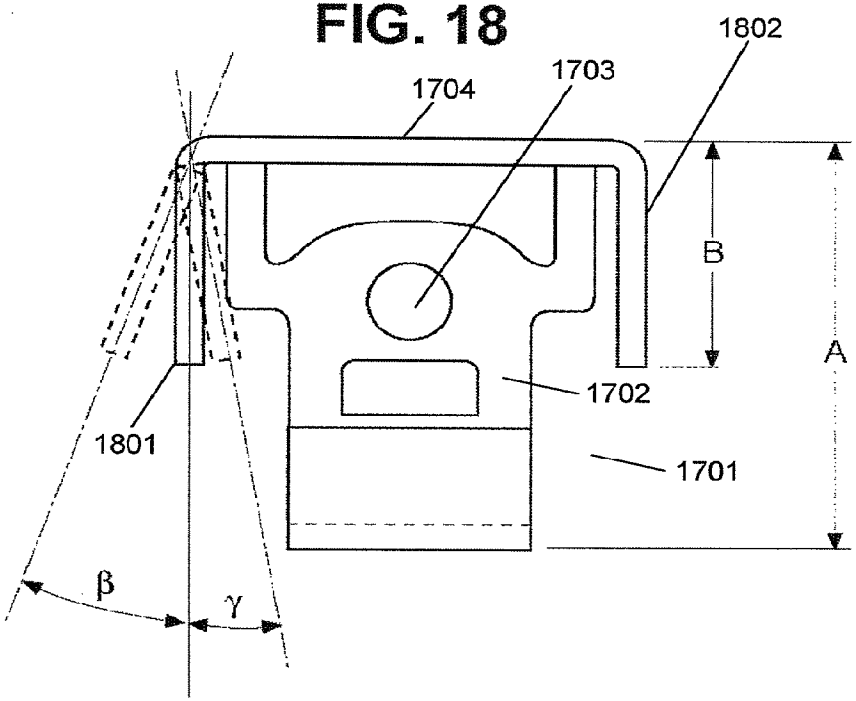
FIG. 18 is a front view of the detail shown in FIG. 17.
Figure 17:
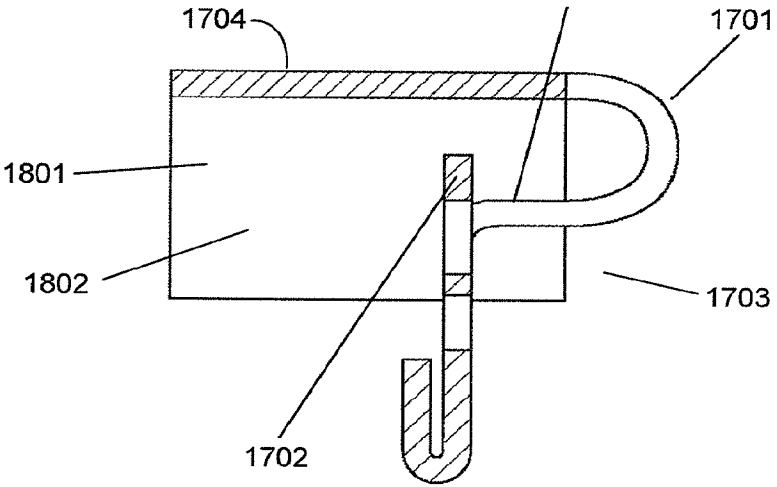
FIG. 17 is a side view partly in section, showing a detail of an embodiment of a fifth aspect of the invention.

FIGS. 17 and 18 show an embodiment of a horizontal sidewall fire protection sprinkler in accordance with another aspect of the invention that can be used in conjunction with the embodiments of the systems shown in FIGS. 1-8. The sprinkler is comprised of a body (not shown) having an output orifice (not shown), a seal cap (not shown) to seal a flow of fluid from the output orifice, a thermally-responsive element (not shown) positioned to releasably retain the seal cap, and a deflector 1701. The deflector 1701 includes a first substantially vertical face 1702 that is transverse to a direction of fluid flow from the output orifice 1703, and a substantially horizontal shelf 1704 positioned above and substantially perpendicular to the first vertical face 1703. The deflector 1701 is also comprised of a substantially second vertical face 1801 and a substantially third vertical face 1802 that are connected to the horizontal shelf 1704 at a sufficient outward angle $\beta$ or inward angle $\gamma$ to direct the flow of water in as desired. A portion 1705 of the horizontal shelf 1704 extends in the direction of fluid flow by a first length, with respect to the first vertical face 1702, and the first length is less than about half of a total length of the horizontal shelf 1704 in the fluid flow direction. The second 1801 and third 1802 vertical faces can be configured to with an angle $\beta$ or $\gamma$ depending on the required fire protection application. Further, it will be apparent to one of skill in the art that the angle $\beta$ or $\gamma$ need not be the same for both the second 1801 and the third 1802 vertical faces.

Figure 12:
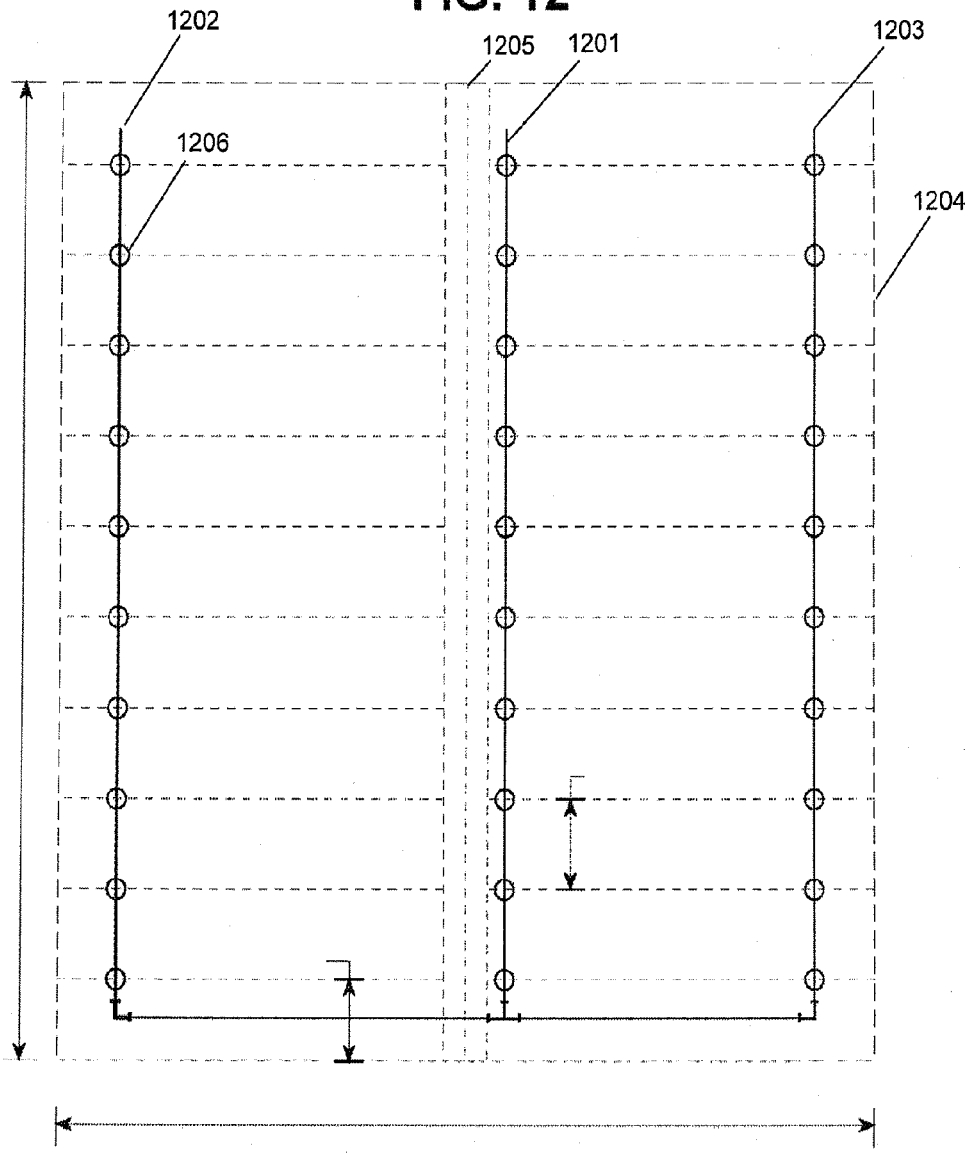
FIG. 12 is a top view of any of the embodiments of the third aspect of the invention shown in FIGS. 9-11.

A third aspect of the invention is embodied in the fire protection system shown in FIG. 12. The system is comprised of a plurality of fluid supply manifolds for supplying a fluid that can serve to suppress or extinguish a fire, including at least a first and a second supply manifold positioned at an effective height below the underside of a roof, the roof having a non-zero pitch angle and having a highest portion and a lowest portion. The effective height is dependent upon the pitch angle, and the second supply manifold is positioned between the first supply manifold and the lowest portion of the roof. Further, the supply manifolds are positioned to supply the fluid in a direction parallel to a ceiling or floor below the respective supply manifold. While the supply manifolds 1201, 1202, and 1203 are shown in FIG. 12 as being substantially parallel to each other, that arrangement is not the only one possible within the scope of the invention, and in alternative embodiments, the supply manifolds need not be so arranged. The system is also comprised of a plurality of fire protection sprinklers each having a deflector and each being connected to one or another of the supply manifolds and positioned such that the deflector is substantially parallel to the floor 410 below the respective deflector, and wherein the sprinklers are spaced within a maximum effective distance from each other.

FIG. 12 shows an embodiment of a system in accordance with the third aspect of the invention. The system is comprised of a plurality of fluid supply manifolds 1202-1203 of which at least a first supply manifold 1201 is positioned at an effective height "x" below the underside of a roof 1204, the distance dependent upon the pitch of the roof, and at least a second supply manifold 1202 positioned below the first supply manifold. The supply manifolds 1201, 1202, and 1203 are substantially parallel to the underside of the roof and to each other. Also the system includes a plurality of upright fire protection sprinklers 1206 connected to the supply manifold and each sprinkler is positioned such that a deflector of each of the respective sprinklers is substantially parallel to the ceiling or floor below the respective deflector, where the sprinklers are spaced within a maximum effective distance from each other.

While the fire protection system of FIG. 12 includes three main supply manifolds 1201-1203 shown connected together in parallel, it will be appreciated by one of skill in the art that an equivalent system could be constructed by supplying each main supply manifold 1201-1203 from a separate fluid supply.

The upright sprinklers 1206 are spaced from each other on a main supply manifold at a suitable minimum effective distance to provide adequate coverage while avoiding wetting (cold soldering) adjacent sprinklers. Further, the distance from the upper main supply manifold 1201 to the lower supply manifolds 1202 and 1203 is a suitable distance to prevent wetting (cold soldering) of sprinklers connected to the lower supply manifolds 1202 and 1203.

Figure 9:
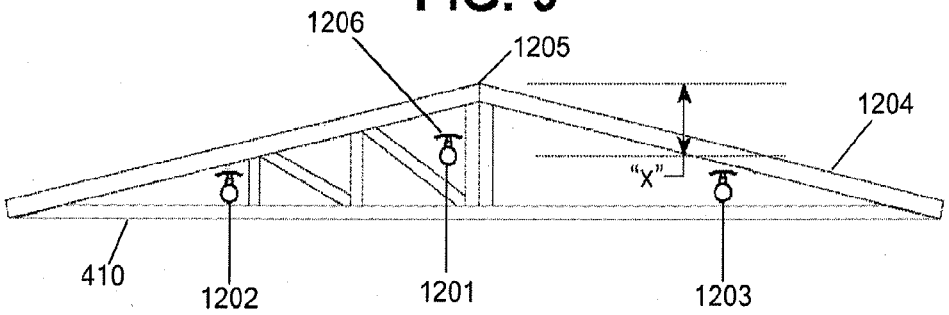
FIG. 9 is a diagram of a front view of an attic fire protection system according to an embodiment of the invention.
Figure 10:
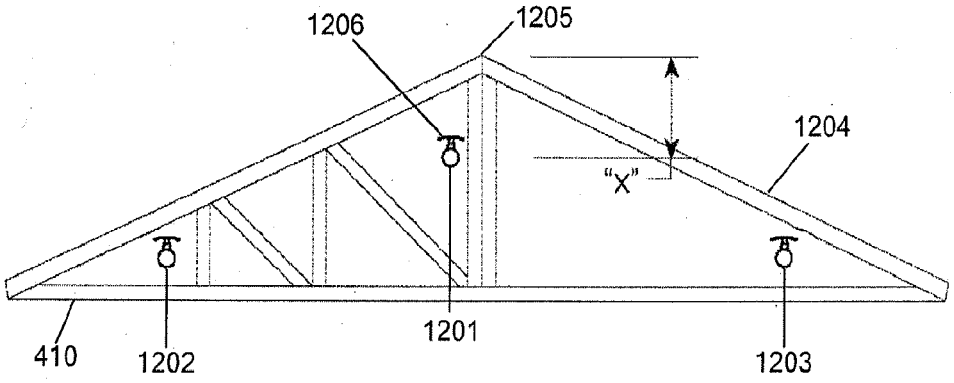
FIG. 10 is a plan view of an embodiment of the third aspect of the invention.
Figure 11:
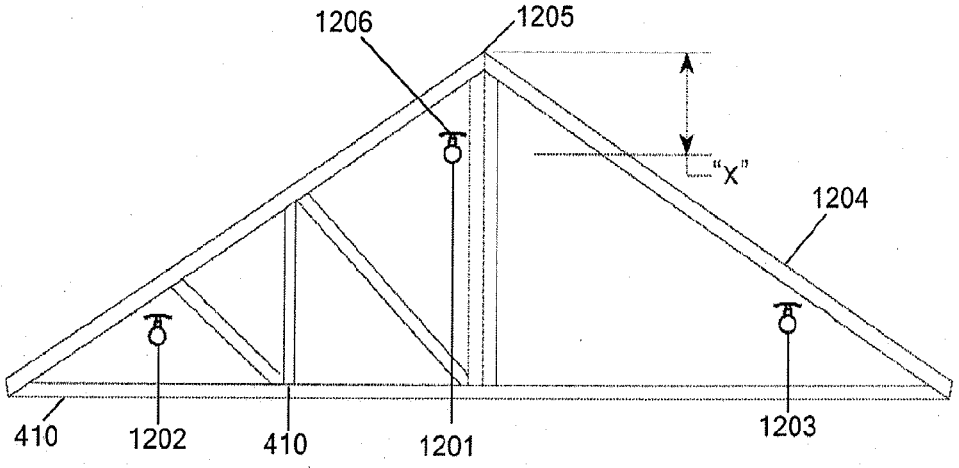
FIG. 11 is a plan view of another embodiment of the third aspect of the invention.

FIGS. 9-11 are side views of different examples of the system shown in FIG. 12. The main supply manifold 1201 runs under the ridge 1205 of the roof at an effective distance "x" and runs substantially parallel to the ridge 1205. Likewise, supply manifolds 1202 and 1203 run parallel to the underside of the roof 1204 and also parallel to the central main supply manifold 1201. Supply manifolds 1202 and 1203 are located a second distance below the central main supply manifold 1201. The first and second distances locate the main supply manifolds 1202 and 1203 at an effective distance from the roof. When installed, the deflectors of the upright sprinklers 1206 are substantially parallel to the floor 410 below the respective sprinkler.

By virtue of the design of the system shown in FIGS. 9-12, conventional upright sprinklers may be used to achieve fire protection coverage equivalent to what would be accomplished using the fire protection systems of FIGS. 4 and 8.

Figure 19A:
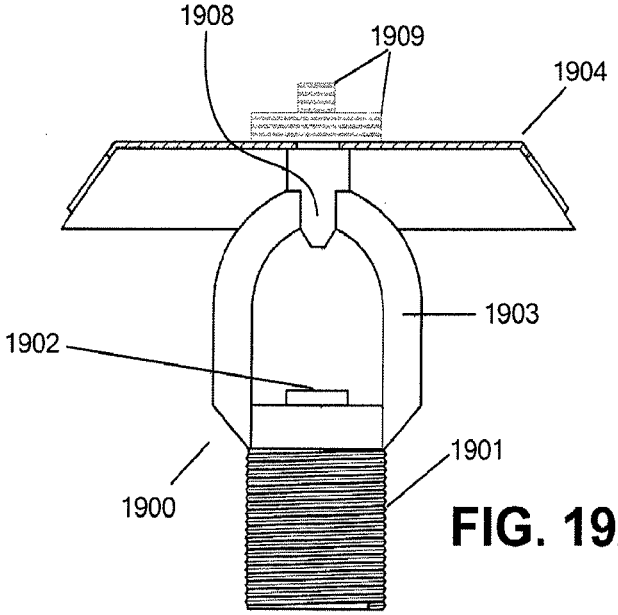
FIG. 19A is a side view, partly in section, of the sprinkler shown in FIG. 19B, in accordance with a sixth aspect of the invention shown in FIGS. 19A-22.
Figure 19B:
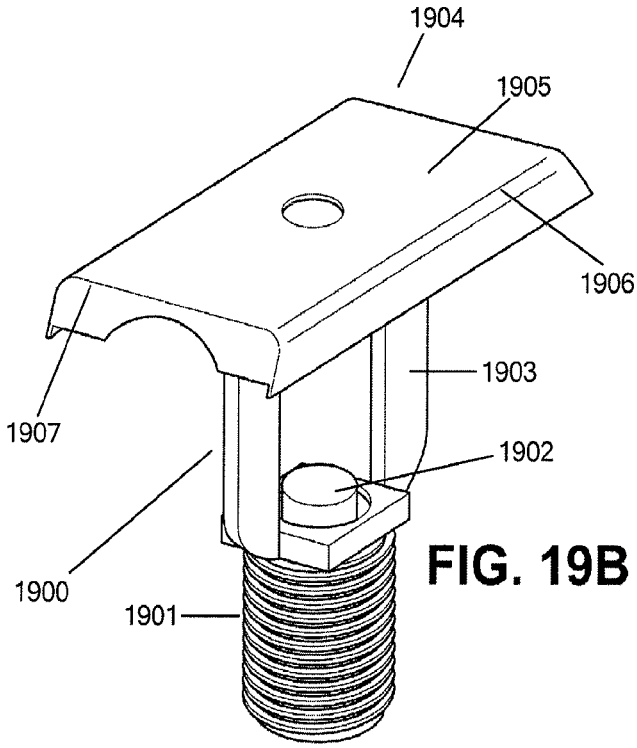
FIG. 19B is a perspective view of one embodiment of an upright fire protection sprinkler.

FIG. 19A shows a portion of an upright fire protection sprinkler 1900 that can be used in conjunction with the embodiments of the systems shown in FIGS. 9-12 and described above (as those in the art will recognize, the closure of the outlet orifice and the activation mechanism are not shown). The sprinkler 1900 is comprised of a body 1901 having an output orifice 1902, a seal cap (not shown) to seal a flow of fluid from the output orifice, a thermally-responsive element (not shown) positioned to releasably retain the seal cap, and a deflector 1904. In the embodiment of FIG. 19B, the deflector 1904 has a rectangular base portion 1905, with its longer peripheral edge 1906 being substantially parallel to the plane in which the frame arms 1903 of the sprinkler lie, and its shorter peripheral edge 1907 being substantially perpendicular to the plane of the frame arms. While the base 1905 is shown as being rectangular, other shapes, including oval, hexagonal, and polygonal can be used and are within the scope of the invention. Moreover, while the base 1905 is shown as being substantially planar, the base can be bent into a plurality of planar and/or curved surfaces.

Figure 20:
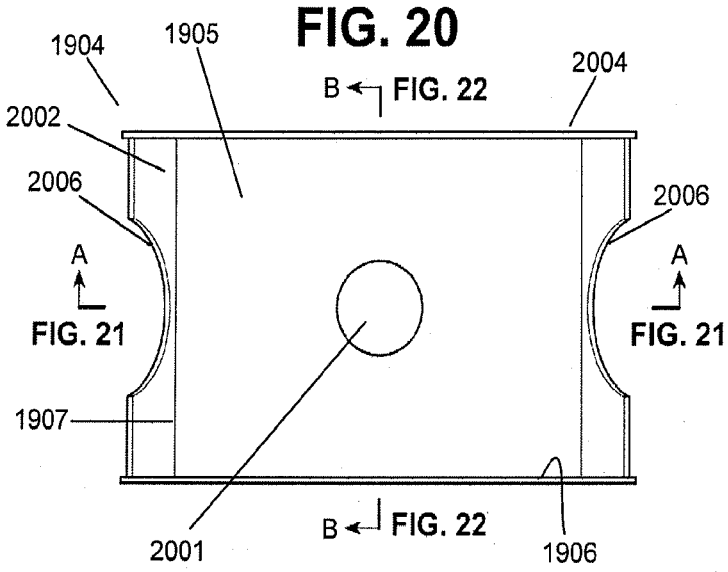
FIG. 20 is a view of the side of the deflector facing an output orifice of the sprinkler shown in FIG. 19A.

Another view of the deflector 1904 of the sprinkler 1900 is provided in FIG. 20, which shows the side of the deflector that is arranged to face the output orifice 1902 (see FIG. 19A). The deflector 1904 includes a through hole 2001 located at or near the center of the rectangular-shaped base 1905, which is used to fasten the deflector 1904 to a hub 1908 of the sprinkler (see FIGS. 19A, 19B) with a suitable fastener 1909 (see FIGS. 19A, 19B). In a preferred embodiment, the base has a length of about 1.73 inches and a width of about 1.22 inches and the hole has a diameter of about 0.33 inches. The frame arms 1903 (see FIGS. 19A, 19B) of the sprinkler extend away from the body 1901 and support the hub 1908 at an apex opposite to the output orifice 1902.

Figure 21:
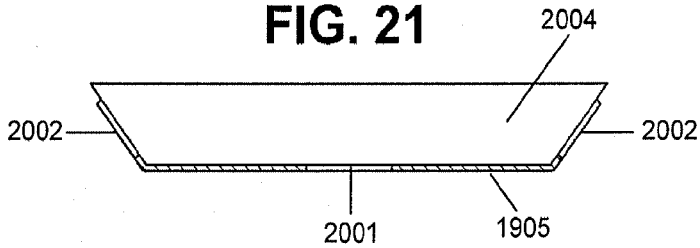
FIG. 21 is a sectional view of the deflector shown in FIG. 20, taken from section line 21-21.
Figure 22:
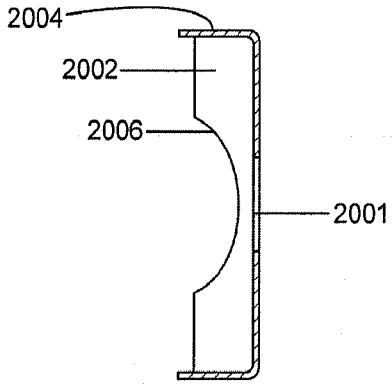
FIG. 22 is another sectional view of the deflector shown in FIG. 20, taken from section line 22-22.

The deflector 1904 includes a plurality of sides 2002 and 2004 extending from the edges 1907, 1906 of the rectangular base, respectively, to help in directing the fluid into a specifically shaped pattern (see e.g., FIG. 23). The sides 2002 extending from the shorter edges 1907 of the base 1905 are formed at a predetermined obtuse angle with respect to the base 1905, as is shown most clearly in FIGS. 19A, 20, and 21. In the preferred embodiment, the sides 2002 have a length of about 1.345 inches and extend about 0.345 inches from the base 1905 at angle of about 133 degrees with respect to the base 1905. The sides 2004 extending from the longer edges of the base 1905 are formed at a predetermined angle with respect to the base, which in the embodiment of FIG. 20 is about ninety degrees to ninety five degrees, and is shown more clearly in the section view in FIG. 22. In the preferred embodiment, the sides 2004 extend about 0.32 inches from the base 1905 and have an overall length at its outer edge of about 2.32 inches. Moreover, the sides 2002, 2004 are joined to each other at their adjoining edges at each of the corners of the deflector base 1905.

At least one of the sides 2002, 2004 (FIG. 20) of the deflector 1904 has at least one cutout portion or slot 2006. The cutout 2006 aids in directing the fluid in a predetermined direction. In the embodiment of the deflector shown in FIG. 20, the shorter sides 2002 each contain a cutout 2006. These cutouts 2006 aid in directing the fluid delivered from the output orifice of the sprinkler from the base 1905 of the deflector 1904 in a direction that is substantially parallel to the lengthwise direction of the deflector 1904. While the shape of the cutout 2006 can be rectilinear, curved, or a combination of both, the cutouts 2006 formed in the sides 2002 shown in FIG. 20 are shaped with the edges being circular arcs. In the preferred embodiment the cutouts have a radius of about 0.38 inches and are centered with respect to the side 2002.

The deflector 1904 can be formed of any suitable material, including brass, steel, and copper. In the preferred embodiment, the deflector is formed from brass having a thickness of 0.062 inches, and is progressively die formed from one blank. When connected to a supply manifold (e.g., 1201-1203), the sprinkler 1900 may be oriented with the plane of the frame arms substantially perpendicular to the length of the supply manifold, the longer dimension of the deflector therefore also being perpendicular to the length of the manifold.

The deflector 1904 shown in FIGS. 19A-22 can be configured to deliver optimized fluid distribution over the design area, and to do so without any potential for "cold soldering" (see above) sprinklers on adjacent manifolds. For example, the sprinklers connected to the first supply manifold 1201 are configured to avoid wetting sprinklers connected to the second supply manifold 1203 and to avoid wetting adjacent sprinklers on the first supply manifold. The supply manifolds 1202 and 1203 are spaced at a suitable distance vertically and horizontally from supply manifold 1201 such that at the expected operating pressure and flow rate at the inlet of the sprinklers connected to supply manifold 1201, the fluid exiting those sprinklers will not wet the lower disposed sprinkles connected to manifolds 1202 and 1203.

Tests were conducted using an embodiment of a sprinkler similar to that shown in FIGS. 19A and 19B. The test sprinkler was attached to a manifold such as manifold 1201 shown in FIG. 12. The orifice size (expressed as a K-factor) of the sprinkler body to which the deflector 1904 was attached was 5.6, where the K-factor is calculated by dividing the flow of water in gallons per minute (GPM) through the sprinkler by the square root of the pressure of water supplied to the sprinkler in pounds per square inch gauge (i.e., GPM/psig$^{1/2}$). Fluid was supplied to the sprinkler at a rate of 35 gallons per minute for a five minute duration, and the amount of water collected on one side of the manifold was measured up to sixteen feet from the sprinkler. The distance from the outer surface of the deflector to the surface of a roof above the deflector was nineteen inches. The pitch of the roof was approximately 34 degrees (pitch of 8/12, rise/run). The water distribution results are shown graphically in FIG. 23, which shows the amount of fluid collected in each of a plurality of pans having a one-square-foot surface area, and disposed to cover a region of 16 feet by four feet extending from beneath the sprinkler in the arrangement shown in the figure. The results compiled were that a total of 13.44 gallons of water were collected in 64 pans, averaging 0.21 gallons per pan. It should be appreciated that while the fluid distribution test results shown in FIG. 23 show the distribution pattern recorded on one side of the manifold those results can be representative of a fluid distribution pattern on the other side of the manifold.

The fluid distribution pattern shown in FIG. 23 using an embodiment of the sprinkler shown in FIGS. 19A and 19B can therefore be substantially directional, with fluid being distributed away from both shorter sides 2002 of the deflector 1904 shown in FIGS. 19A and 19B, in substantially opposite directions. Such a directional fluid distribution pattern can be useful for the attic fire protection systems described above with respect to FIGS. 9-12, such as when connected to supply manifold 1201, since directional streams of fluid can be distributed away from the supply manifold 1201 in substantially a perpendicular direction thereto between the trusses or beams of the attic at suitable distance from the manifold, while also controlling the width of the distribution pattern on either side of the sprinkler along the manifold.

A second test was conducted under the same test conditions using a single-direction sprinkler having a deflector configured to direct fluid in a direction about 28 degrees below the horizontal, similar to a sprinkler described in U.S. Pat. No. 5,669,449. The results of that test are summarized graphically in FIG. 24, which shows the distribution of collected fluid in each of a plurality of one-square-foot pans disposed to cover an area of sixteen feet by four feet extending from the location of the sprinkler. After five minutes of testing, again with a fluid supply rate of 35 gallons per minute, only 2.27 gallons of fluid were collected, averaging only 0.035 gallons per collection pan. Therefore, the sprinkler configured according to an embodiment of the invention was capable of delivering, in identical collection area, on average, six times as much fluid per square foot as the sprinkler configured according to U.S. Pat. No. 5,669,449. One advantage of distributing more fluid over the same duration and over the same coverage area is reduced cost, at least in part due to a reduction in the number of sprinklers needed to protect an equivalent area.

Figure 25A:
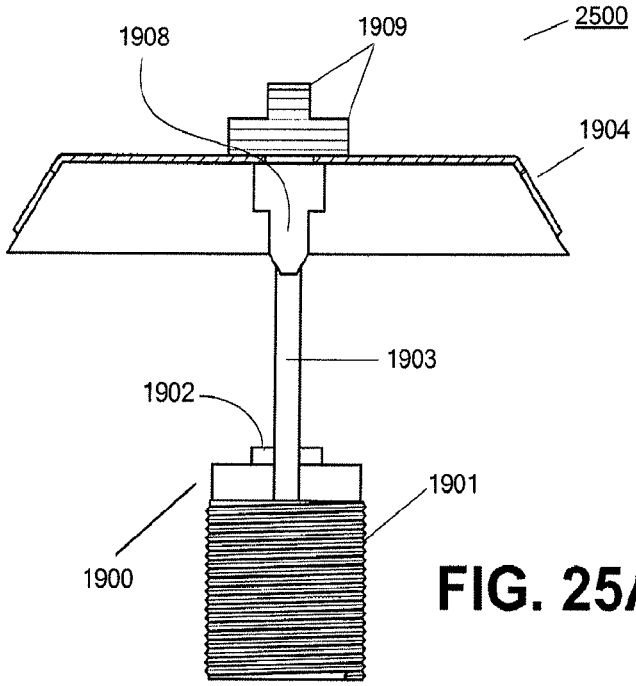
FIG. 25A is a side view, partly in section, of the sprinkler shown in FIG. 25B.
Figure 25B:
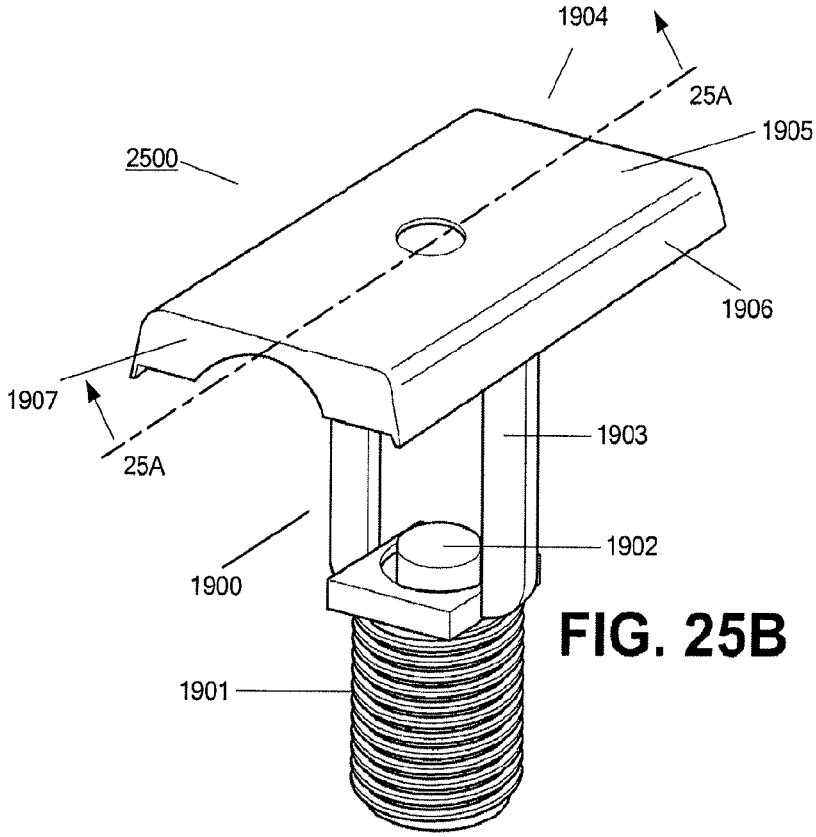
FIG. 25B is a perspective view of another embodiment of an upright fire protection sprinkler.

FIG. 25B shows a perspective view of a portion an alternate embodiment 2500 of the upright fire protection sprinkler 1900, where the longer peripheral edge 1906 of the deflector 1904 is configured to be substantially perpendicular to the plane in which the frame arms 1903 of the sprinkler lie, and its shorter peripheral edge 1907 being substantially parallel to the plane of the frame arms. FIG. 25A shows a view along section 25A-25A shown in FIG. 25B, and shown with the deflector 1904 connected to the hub 1908 with fastener 1909.

Figure 26:
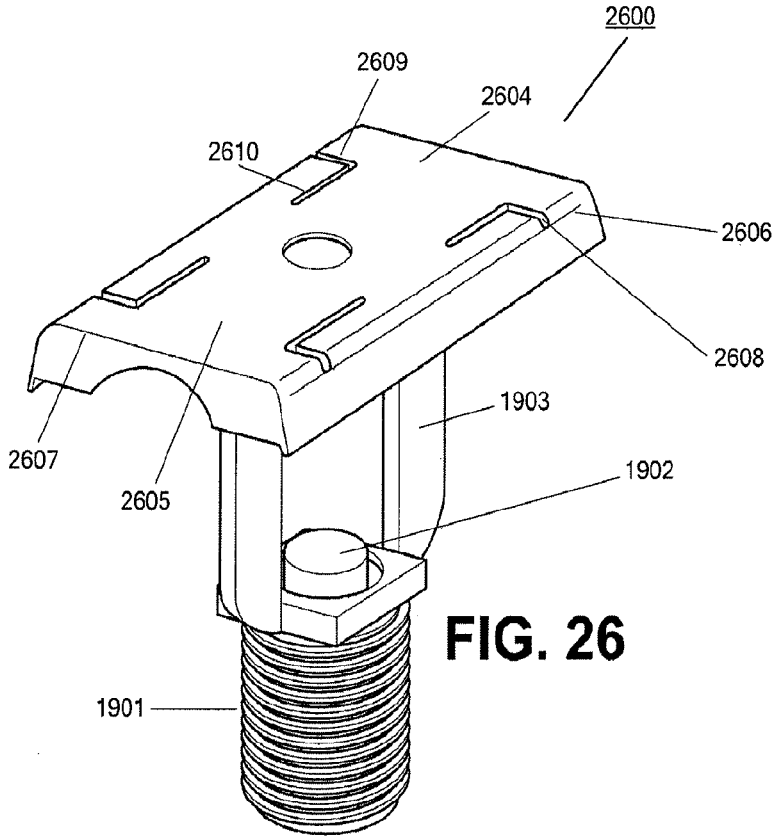
FIG. 26 is a perspective view of another embodiment of an upright fire protection sprinkler.

FIG. 26 shows another embodiment of a an upright fire protection sprinkler 2600, similar in construction to the sprinkler 1900, that can be used in conjunction with the embodiments of the systems shown in FIGS. 9-12 and described above (as those in the art will recognize, the closure of the outlet orifice and the activation mechanism are not shown). The sprinkler 2600 shares many of the same components as that of sprinkler 1900 except the deflector 1904, which is replaced with a deflector 2604. The deflector 2604 has a rectangular base portion 2605, having longer peripheral edges 2606 being substantially parallel to the plane in which the frame arms 1903 of the sprinkler lie, and having shorter peripheral edges 2607 being substantially perpendicular to the plane of the frame arms 1903. In a preferred embodiment the deflector 2604 has common dimensions with the preferred embodiment of the deflector 1904, described above.

The deflector 2604 has a plurality of L-shaped slots 2608. Each of the slots 2608 has a first leg 2609 that extends inwardly from a side 2706 (FIG. 27) a predetermined distance and has a second leg 2610, substantially perpendicular to the first leg that also extends inwardly. The first leg 2609 extends substantially parallel to the shorter peripheral edge 2607, while the second leg 2610 extends substantially parallel to the longer peripheral edge 2606. The width of the slots is substantially uniform and in the preferred embodiment is about 0.065 inches.

Figure 27:
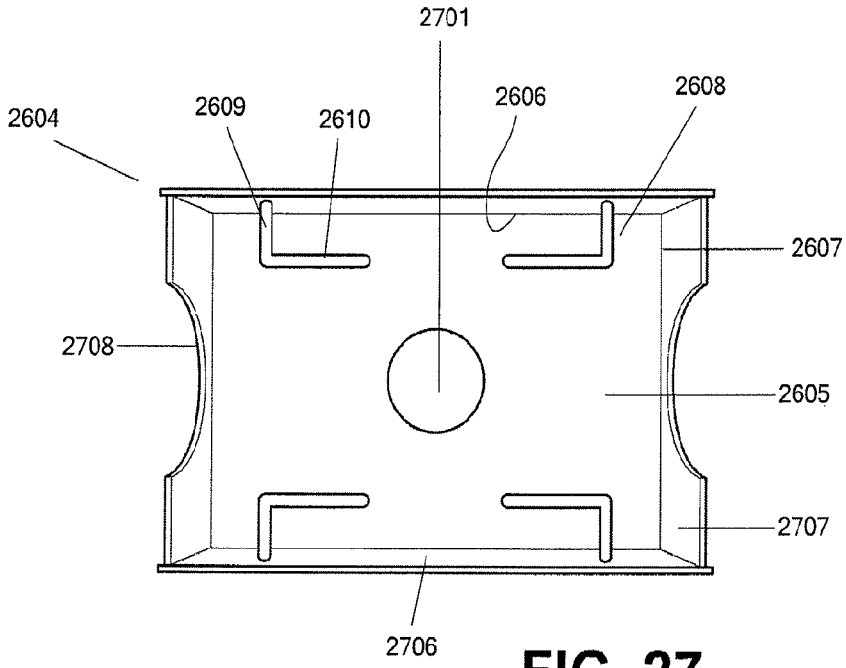
FIG. 27 is a view of the side of the deflector facing an output orifice of the sprinkler shown in FIG. 26.

FIG. 27 shows another view of the deflector 2604 of the sprinkler 2600, and shows the side of the deflector 2604 that is arranged to face the output orifice 1902 (see FIG. 26). The deflector 2604 includes a through hole 2701 located at or near the center of the rectangular-shaped base 2605, which is used to fasten the deflector 2604 to a hub 1908 of the sprinkler (see, e.g., FIGS. 19A, and 25A) with a suitable fastener 1909. The frame arms 1903 (see FIGS. 19A, 19B, 26) of the sprinkler 2600 extend away from the body 1901 and support the hub 1908 at an apex opposite to the output orifice 1902.

The deflector 2604 includes a plurality of sides 2707, 2706 extending from the edges 2607, 2606 of the rectangular base, respectively, to help in directing the fluid into a specifically shaped pattern. The sides 2707 extending from the shorter edges 2607 of the base 2605 are formed at a predetermined obtuse angle with respect to the base 2605, similar to sides 2002 shown most clearly in FIG. 21. The sides 2706 extending from the longer edges 2606 of the base 2605 are formed at a predetermined angle with respect to the base, which in the embodiment of FIG. 27 is about ninety to ninety-five degrees. The sides 2706, 2707 are joined to each other at their adjoining edges at each of the corners of the deflector base 2605.

The deflector 2604 shown in FIG. 27, includes a cutout 2708 in each of the shorter sides 2707. The cutouts 2708 aid in directing the fluid delivered from the output orifice 1902 of the sprinkler 2600 from the base 2605 of the deflector 2604 in a direction that is substantially parallel to the lengthwise direction of the deflector 2604. While the shape of the cutouts 2708 can be rectilinear, curved, or a combination of both, the cutouts 2708 shown in FIG. 27 are formed with the edges being circular arcs. When the sprinkler 2600 is used in conjunction with the embodiments of the systems shown in FIGS. 9-12 the slots permit a controlled amount of water spray to wet the underside surface of roof directly over and in close proximity of the discharging sprinkler(s) 2600.

Figure 28:
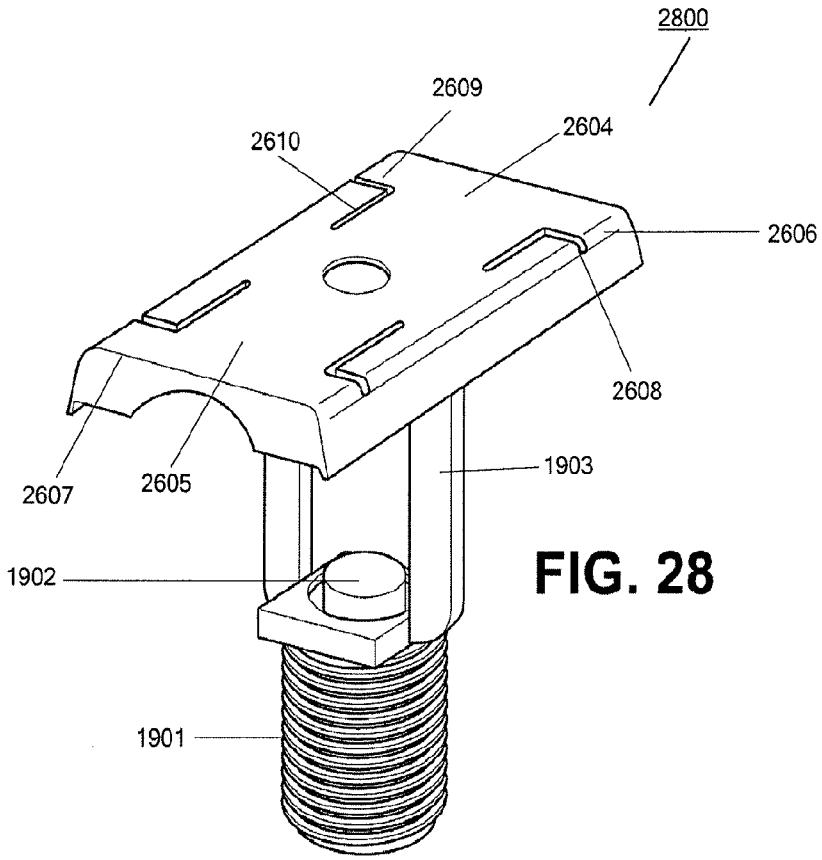
FIG. 28 is a perspective view of another embodiment of an upright fire protection sprinkler.

FIG. 28 shows an alternate embodiment 2800 of the sprinkler 2600, where the deflector 2604 is rotated ninety degrees with respect to the plane of the frame arms 1903.

Similarly to the deflector 1904, the deflector 2604 may be formed from brass or other suitable material, such as by progressive die stamping a single blank into a formed deflector.

Figure 29:
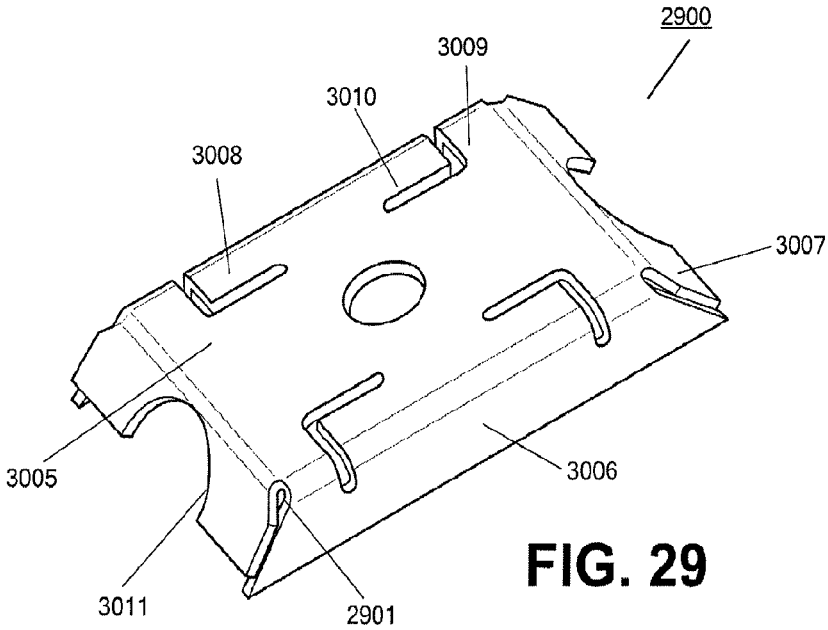
FIG. 29 is a perspective view of another embodiment of a formed deflector in accordance with an aspect of the invention.
Figure 30:
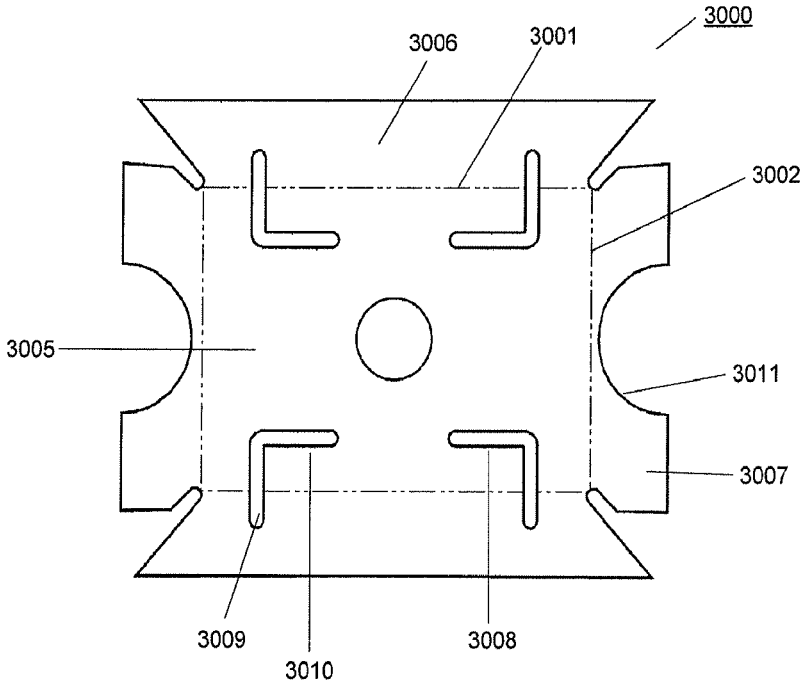
FIG. 30 is a plan view of a flat blank used to form the deflector shown in FIG. 29.

FIG. 29 shows an alternate embodiment 2900 of the deflector 2604 shown in FIGS. 26-28, which can be configured to be used in place of the deflector 2604 shown in FIGS. 26 and 28. The deflector 2900 is formed by die-bending a milled blank 3000, shown in FIG. 30. In a preferred embodiment the formed deflector 2900 has common dimensions with the preferred embodiments of the deflectors 1904 and 2604, described above.

The blank 3000 includes a base portion 3005 that is substantially rectangular shape. The blank includes sides 3007 extending from bend lines 3002 along the shorter side of the base portion 3005. The blank 3000 also includes sides 3006 extending from bend lines 3001 along the longer side of the base portion 3005. The blank 3000 also includes a plurality of L-shaped slots 3008 formed therethrough. The slots 3008 include a first leg extending from a point on side 3006 that is a certain distance from bend line 3001. The first leg extends from side 3006 inwardly a certain distance into the base portion 3005. The slots 3008 also include a second leg 3010, substantially perpendicular to the first leg, that also extends inwardly another certain distance. The first leg 3009 extends substantially parallel to the shorter bend line 3002, while the second leg 3010 extends substantially parallel to the longer bend line 3001. The width of the slots is substantially uniform and in one embodiment is about 0.065 inches.

The sides 3007 include cutouts 3011. The cutouts 3011 aid in directing fluid delivered from the output orifice 1902 (FIGS. 19A, 19B, 26, and 28) from the base 3005 of the deflector 2900 in a direction that is substantially parallel to the lengthwise direction of the deflector 2900. While the shape of the cutout 3011 can be rectilinear, curved, or a combination of both, the cutouts 3011 formed in the sides 3007 are shaped with the edges being circular arcs.

The flat blank 3000 is configured to permit the sides 3006, 3007 to be bent together along their respective bend lines 3001, 3002 to form corners 2901 (FIG. 29). The resulting deflector 2900 is configured to have substantially the same shape and dimensions as the die-formed version of the deflector 2604.

As mentioned above, one aspect of the invention is a fire protection sprinkler utilizing the deflector described above, which it will be appreciated is particularly suitable for use in the system according to the embodiments described above. Such sprinkler comprises a body having an output orifice, a seal cap to seal a flow of fluid from the output orifice, a thermally-responsive element positioned to releasably retain the seal cap, and the deflector.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. Moreover, the preferred embodiments of fittings described herein are described with reference to sprinklers which may be used in conjunction with the fittings, which in many embodiments can be conventional sprinklers attached to the novel fittings, it is nevertheless within the scope of the invention for the structure of the fitting itself to be provided as part of the sprinkler itself, as well.

What is claimed is:

1. An attic fire protection system comprising:

a fluid supply manifold for supplying a fluid, positioned at an effective height below and parallel to the underside of a roof having a non-zero pitch angle;

a plurality of fittings each having at least one exit port for directing the flow of the fluid, the fittings being spaced within at most a maximum effective distance apart from each other and being connected perpendicular to said supply manifold, wherein said fittings are structured to supply the fluid in a direction parallel to the underside of the roof, along the pitch of the roof; and a plurality of horizontal sidewall sprinklers each connected to a respective exit port of one or another of said fittings.

2. The system according to claim 1, wherein said plurality of fittings comprises a plurality of two-port angled fittings each having an inlet port and an exit port that are co-planar with each other and that are positioned at a fixed oblique angle relative to each other, connected such that said exit ports of said two-port angled fittings are positioned parallel to the underside of the roof.

3. The system according to claim 1, wherein said supply manifold is angled at at least one point along its length, such that said point is adjacent a location where two portions of the underside of the roof meet at an angle, wherein said supply manifold is angled at substantially the same angle as the angle in which the two portions of the underside of the roof meet, and wherein said supply manifold is spaced by said effective height from each of the two portions of the underside of the roof.

4. The system according to claim 1, wherein said supply manifold has connected to it, at an angle, at least a second supply manifold, and supplies the fluid to said second supply manifold, said second supply manifold being positioned at an effective height below and parallel to a portion of the underside of the roof, and said system further comprising a plurality of additional fittings, each having an exit port and each being connected to said second supply manifold with said exit port directed to supply the fluid in a direction parallel to that portion of the underside of the roof.

5. The system according to claim 1, wherein said exit ports are structured to supply fluid in a direction perpendicular to the supply manifold.

6. An attic fire protection system comprising:

a plurality of fluid supply manifolds for supplying a fluid, each positioned at an effective height below and parallel to one or more portions of the underside of a roof having a non-zero pitch angle;

a plurality of two-port angled fittings each having an inlet port and an exit port that are co-planar with each other and that are positioned at a fixed oblique angle relative to each other, connected such that said exit ports of said two-port angled fittings are positioned parallel to the underside of the roof; and a plurality of horizontal sidewall sprinklers each connected to a respective exit port of one or another of said two-port angled fittings.

7. An attic fire protection system comprising:

a plurality of fluid supply manifolds for supplying a fluid, including at least a first and a second supply manifold positioned at an effective height below the underside of a roof, the roof having a non-zero pitch angle and having a highest portion and a lowest portion, the effective height being dependent upon the pitch angle, and said second supply manifold being positioned between said first supply manifold and the lowest portion of the roof, wherein said supply manifolds are parallel to each other, are spaced vertically from each other, and are positioned to supply the fluid in a direction parallel to the underside of the roof; and a plurality of upright residential fire protection sprinklers each having a deflector and each being connected to one or another of said supply manifolds and positioned such that said deflector is parallel to the underside of the roof, and wherein the sprinklers are spaced within a maximum effective distance from each other.

8. In combination, a fitting for directing the flow of a fluid, and a horizontal sidewall fire protection sprinkler, the sprinkler comprising:

a sprinkler body having an output orifice;

a seal cap to seal a flow of fluid from the output orifice;

a thermally-responsive element positioned to releasably retain the seal cap; and a deflector having a first face that is transverse to a direction of fluid flow from the output orifice, a shelf positioned above and substantially perpendicular to said first face, and second and third faces connected to said shelf along edges of said shelf that are perpendicular to said first face, wherein at least one of said second and third faces is connected to said shelf at an oblique angle, and said fitting comprising:

a fitting body;

at least one inlet port in said fitting body, for connecting to a fluid supply manifold;

at least one exit port in said fitting body, for connecting to the sprinkler and directing the flow of the fluid, wherein said fitting body is structured to cause the fluid to exit through said exit port in a direction that is at an oblique angle to a direction in which the fluid passes in entering said inlet port, wherein the oblique angle is substantially the same as a pitch angle of the underside of a roof under which the fitting is positioned.

9. An upright fire protection sprinkler, comprising:

an upright sprinkler body having an output orifice for directing fluid along an axis;

a seal cap to seal a flow of fluid from the output orifice;

a thermally responsive element positioned to releasably retain the seal cap; and a deflector having means for directing flow in at least a first direction away from the axis, and for directing flow toward the axis in a second direction that is perpendicular to the first direction and to the axis.

10. The upright sprinkler of claim 9, wherein said deflector has a profile which, as seen from a position on the axis of fluid flow from said orifice, extends a first length in the second direction transverse to the direction of fluid flow, and extends a second length, shorter than the first length, in a third direction that is transverse to the direction of fluid flow and transverse to said second direction.

11. The upright sprinkler of claim 10, wherein the deflector has a rectangular base connected to the body facing the output orifice, the deflector having a first pair of opposed sides extending from a longer edge of the base towards the output orifice and having a second pair of opposed sides extending from a shorter edge of the base towards the output orifice.

12. The upright sprinkler of claim 11, wherein at least one side of the second pair of opposed sides has at least one slot extending from an outer edge thereof.

13. The upright sprinkler of claim 10, wherein said profile is substantially oval in shape.

14. The upright sprinkler of claim 10, wherein said profile is substantially polygonal in shape.

15. The upright sprinkler of claim 10, wherein said profile is substantially hexagonal in shape.

16. An upright fire protection sprinkler comprising:

a body having an output orifice;

a seal cap to seal a flow of fluid from the output orifice;

a thermally-responsive element positioned to releasably retain the seal cap; and a deflector having a rectangular base connected to the body facing the output orifice, the deflector having a first pair of opposed sides extending from a longer edge of the base towards the output orifice and having a second pair of opposed sides extending from a shorter edge of the base towards the output orifice, wherein at least one side of the second pair of opposed sides has at least one slot extending from an outer edge thereof, and wherein the outer edge is perpendicular to the first pair of opposed sides.

17. The upright fire protection sprinkler according to claim 16, wherein the second pair of opposed sides extend at an obtuse angle with respect to the base.

18. The upright fire protection sprinkler according to claim 17, wherein the notch in the second pair of opposed sides is formed as a circular arc.

19. The upright fire protection sprinkler according to claim 18, wherein the first pair of opposed sides extend substantially perpendicularly with respect to the base.

20. The upright fire protection sprinkler according to claim 18, wherein the second pair of opposed sides extend at about 133 degrees with respect to the base.

21. The upright fire protection sprinkler according to claim 20, wherein the second pair of opposed sides extend about 0.345 inches from the base.

22. The upright fire protection sprinkler according to claim 21, wherein the first pair of opposed sides extend about 0.320 inches from the base.

23. The upright fire protection sprinkler according to claim 22, wherein the longer edge of the base is about 1.73 inches, and the shorter edge of the base is about 1.22 inches.

24. The upright fire protection sprinkler according to claim 23, wherein the arc has a radius of about 0.38 inches.

25. The upright fire protection sprinkler according to claim 19, wherein the body further includes a pair of frame arms extending from the body toward the deflector and meeting at a hub, wherein the deflector is connected to the hub and the first pair of opposed sides are positioned substantially parallel to a plane of the frame arms.

26. The upright fire protection sprinkler according to claim 19, wherein the body further includes a pair of frame arms extending from the body toward the deflector and meeting at a hub, wherein the deflector is connected to the hub and the first pair of opposed sides are positioned substantially perpendicular to a plane of the frame arms.

27. The upright fire protection sprinkler according to claim 19, wherein the base and the first pair of opposed sides include a plurality of slots formed therein.

28. The upright fire protection sprinkler according to claim 27, wherein the plurality of slots are substantially L-shaped.

29. The upright fire protection sprinkler according to claim 28, wherein the slot has a first leg that extends inwardly from a the first pair of opposed sides and the base a first predetermined distance and has a second leg, substantially perpendicular to the first leg, that extends inwardly of the base a second predetermined distance.

30. The upright fire protection sprinkler according to claim 29, wherein the first leg extends substantially parallel to the second pair of sides and shorter the second leg extends substantially parallel to the first pair of sides.

31. The upright fire protection sprinkler according to claim 30, wherein the body further includes a pair of frame arms extending from the body toward the deflector and meeting at a hub, wherein the deflector is connected to the hub and the first pair of opposed sides are positioned substantially parallel to a plane of the frame arms.

32. The upright fire protection sprinkler according to claim 31, wherein the slot has a width of about 0.065 inches.

33. The upright fire protection sprinkler according to claim 30, wherein the body further includes a pair of frame arms extending from the body toward the deflector and meeting at a hub, wherein the deflector is connected to the hub and the first pair of opposed sides are positioned substantially perpendicular to a plane of the frame arms.

34. The upright fire protection sprinkler according to claim 33, wherein the slot has a width of about 0.065 inches.

35. An attic fire protection system comprising:

a fluid supply manifold for supplying a fluid, positioned at an effective height below and parallel to the underside of a roof having a first non-zero pitch angle;

a plurality of fittings each having at least one exit port for directing the flow of the fluid, the fittings being spaced within at most a maximum effective distance apart from each other and being connected perpendicular to said supply manifold, wherein said exit ports are structured to supply the fluid in a direction, along the pitch of the roof, that is at a second angle relative to the underside of the roof, said second angle not being equal to the first pitch angle; and a plurality of horizontal sidewall sprinklers each connected to a respective exit port of one or another of said fittings.

36. The system of claim 35, wherein the second angle is equal to or greater than zero degrees.

37. The system of claim 35, wherein the second angle is equal to or less than zero degrees.

* * * * *